US008070249B2

(12) United States Patent
Takahashi et al.

(10) Patent No.: US 8,070,249 B2
(45) Date of Patent: Dec. 6, 2011

(54) INKJET PRINTING APPARATUS AND INKJET PRINTING METHOD

(75) Inventors: Kiichiro Takahashi, Yokohama (JP); Minoru Teshigawara, Yokohama (JP); Tetsuya Edamura, Kawasaki (JP); Akiko Maru, Tokyo (JP); Yoshiaki Murayama, Tokyo (JP); Takatoshi Nakano, Tokyo (JP); Hiroshi Taira, Chofu (JP)

(73) Assignee: Canon Kabushiki Kaisha, Tokyo (JP)

( * ) Notice: Subject to any disclaimer, the term of this patent is extended or adjusted under 35 U.S.C. 154(b) by 698 days.

(21) Appl. No.: 12/190,890

(22) Filed: Aug. 13, 2008

(65) Prior Publication Data

US 2009/0051721 A1 Feb. 26, 2009

(30) Foreign Application Priority Data

Aug. 20, 2007 (JP) ..... 2007-214041
Aug. 20, 2007 (JP) ..... 2007-214057

(51) Int. Cl.
*B41J 29/38* (2006.01)

(52) U.S. Cl. ..... 347/16; 347/14

(58) Field of Classification Search ..... 347/16
See application file for complete search history.

(56) References Cited

U.S. PATENT DOCUMENTS

| | | | | |
|---|---|---|---|---|
| 5,500,661 | A * | 3/1996 | Matsubara et al. | 347/41 |
| 5,594,478 | A | 1/1997 | Matsubara et al. | |
| 5,604,520 | A | 2/1997 | Matsubara et al. | |
| 5,739,828 | A * | 4/1998 | Moriyama et al. | 347/9 |
| 6,053,595 | A | 4/2000 | Otsuka et al. | |
| 6,390,598 | B2 * | 5/2002 | Sato et al. | 347/41 |
| 6,406,114 | B1 * | 6/2002 | Shioya | 347/15 |
| 6,582,047 | B2 * | 6/2003 | Koitabashi et al. | 347/16 |
| 6,669,331 | B2 | 12/2003 | Teshigawara et al. | |
| 6,729,710 | B2 | 5/2004 | Chikuma et al. | |
| 6,779,873 | B2 | 8/2004 | Maeda et al. | |
| 7,467,847 | B2 * | 12/2008 | Baxter et al. | 347/41 |
| 7,878,632 | B2 * | 2/2011 | Kachi | 347/84 |
| 2002/0140753 | A1 * | 10/2002 | Danzuka et al. | 347/16 |
| 2002/0171709 | A1 | 11/2002 | Teshigawara et al. | |
| 2003/0002064 | A1 * | 1/2003 | Otsuki | 358/1.13 |
| 2005/0073535 | A1 * | 4/2005 | Seki et al. | 347/5 |
| 2005/0104915 | A1 | 5/2005 | Hara | |
| 2006/0038846 | A1 * | 2/2006 | Chikuma et al. | 347/16 |
| 2007/0132809 | A1 * | 6/2007 | Hara | 347/40 |

FOREIGN PATENT DOCUMENTS

| | | | |
|---|---|---|---|
| JP | 2003-34021 | A | 2/2003 |
| JP | 2005-144868 | A | 6/2005 |

* cited by examiner

*Primary Examiner* — Charlie Peng
(74) *Attorney, Agent, or Firm* — Fitzpatrick, Cella, Harper & Scinto

(57) ABSTRACT

After a first scan in a forward direction, conveying corresponding to one nozzle block is performed, and then in a second scan in a backward direction, printing of a "printing area 1," which is a unit area, is completed. Then after completion of printing of the unit area, conveying corresponding to 14 nozzle blocks is performed. Then by reciprocal third and fourth scans, printing of a "printing area 2" is completed in a likewise manner. Subsequently, two scans in a reciprocal manner are performed in a likewise manner to perform printing of each unit area. In any unit area, printing time intervals between scans are such that, at a same position in a scan direction, the time interval is the same. Consequently, differences in density between unit areas that are adjacent in a conveying direction of a printing medium, that is, between-band unevenness becomes more difficult to recognize.

3 Claims, 24 Drawing Sheets

| DIVIDED AREA IN SCAN DIRECTION | 1 | 2 | 3 | 4 | 5 | 6 | 7 | 8 |
|---|---|---|---|---|---|---|---|---|
| MAXIMUM VALUE OF INK APPLYING AMOUNT | 93% | 94% | 95% | 96% | 97% | 98% | 99% | 100% |

FIG.22

| DIVIDED AREA IN SCAN DIRECTION | 1 | 2 | 3 | 4 | 5 | 6 | 7 | 8 |
|---|---|---|---|---|---|---|---|---|
| OUTPUT GAMMA CORRECTION TABLE | Table1 | Table2 | Table3 | Table4 | Table5 | Table6 | Table7 | Table8 |

FIG.23

| DIVIDED AREA IN SCAN DIRECTION | | 1 | 2 | 3 | 4 | 5 | 6 | 7 | 8 |
|---|---|---|---|---|---|---|---|---|---|
| MAXIMUM VALUE OF INK APPLYING AMOUNT | PRINTING MEDIUM 1 | 97% | 97% | 98% | 98% | 99% | 99% | 100% | 100% |
| | PRINTING MEDIUM 2 | 93% | 94% | 95% | 96% | 97% | 98% | 99% | 100% |
| | PRINTING MEDIUM 3 | 86% | 88% | 90% | 92% | 94% | 96% | 98% | 100% |

FIG.24

INKJET PRINTING APPARATUS AND INKJET PRINTING METHOD

BACKGROUND OF THE INVENTION

1. Field of the Invention

The present invention relates to an inkjet printing apparatus and an inkjet printing method, and specifically relates to a configuration for reducing density unevenness that occurs when printing is performed by reciprocal, bidirectional scanning.

2. Description of the Related Art

Personal computers, word processors, and other office automation devices have come to be used widely in recent years, and various printing apparatuses are provided for printing out information processed by such devices. As a trend of such printing apparatuses, high image quality and high speed are being demanded, and various techniques for these purposes are provided.

High Quality Image Printing Technologies

As an example of a high image quality technology, a so-called multi-scan method is known. With this method, scanning of a print head is performed a plurality of times on a same region and in the plurality of scans, different ink ejection ports are set to be used to perform printing.

In a case of performing printing using a print head that is provided with a plurality of printing elements, such as ink ejection ports, etc., a quality of a printed image is largely dependent on a precision of the print head. In a print head manufacturing process, for example, fluctuations may arise in shapes of the ejection ports of the print head or in a set position of an ejection heater for generating energy for ejection. Such fluctuations become apparent as slight differences in ejection amount, ejection direction, and other ejection characteristics among the plurality of ejection ports in the print head and, cause density unevenness in an image finally formed to decrease the grade of the image.

FIGS. 1A to 1C and FIGS. 2A to 2C are diagrams for explaining specific examples of the above-described degradation of the image. In FIG. 1A, a reference sign 101 schematically denotes a print head, and for simplification of description, this is illustrated as having eight ink ejection ports 102. A reference sign 103 denotes ink droplets ejected from the respective ejection ports 102, and normally, it is assumed that ink is ejected at a substantially same ejection amount and in a same ejection direction as shown in the figure. By such ejection, dots of a substantially same size are formed on a paper surface as shown in FIG. 1B and a uniform image without density unevenness as a printing image as a whole is obtained (see FIG. 1C).

However, as mentioned above, in actuality, there are fluctuations in the respective ejection characteristics of the plurality of ejection ports in many cases. As a result, fluctuations may occur in the sizes and directions of ink droplets ejected from the respective ejection ports as shown in FIG. 2A. Consequently, dots that differ in position and size may be formed as shown in FIG. 2B. In this case, a blank portion, in which an area factor of 100% is not attained, or oppositely, a portion, in which dots are overlapped more than necessary, may arise in a cyclical manner and a white streak or black streak may form as shown in a central portion of the figure. An image formed with a set of dots having such state has a density distribution in an ejection port array direction such as shown in FIG. 2C and this is consequently perceived as density unevenness.

A multi-scan method resolves such a problem of density unevenness to improve the image quality. FIGS. 3A to 3C and FIGS. 4A to 4C are diagrams for explaining this method. In the multi-scan method, a plurality of scans, that is, in the example shown in FIG. 3A, two scans of a print head are performed to complete printing of a predetermined area (in the examples shown in these figures, a 100% duty printing of forming dots respectively in all pixels in the predetermined are). More specifically, an area (corresponding to four pixels) of half the area shown in FIG. 1B or the like is completed by two scans (herein after, also referred to as "two passes") between which a printing medium is conveyed by an amount corresponding to the area corresponding to four pixels. In this case, eight ink ejection ports 202 of a head 201 are divided into a group of four upper ejection ports and a group of four lower ejection ports. In addition to the above, the dots formed by the ink ejected from a single ejection port in a single scan are thinned, for example, by half in a scan direction array by using a mask. A remaining half of the dots are then formed in a second scan using a mask that complements the aforementioned mask to complete printing of the area corresponding to four pixels. FIGS. 4A to 4C are diagrams of an example of a mask and a dot pattern formed using the mask. The mask and the dot pattern shown in these drawings are of a checker pattern, which is the simplest pattern according to which dots can be formed vertically and horizontally in each pixel. The printing is completed by a first scan (FIG. 4A or 4C), by which the checker pattern is printed in a unit print area (corresponding to four pixels in the present case), and a second scan (FIG. 4B) of printing a complementary checker pattern.

With the above-described multi-scan method, even when the print head having the ejection characteristics shown in FIG. 2A is used, the influence of the ejection characteristics of the respective ejection ports can be reduced to ½ and the printed image becomes as shown in FIG. 3B. White streaks or black streaks can thereby be made less conspicuous. Consequently as shown in FIG. 3C, the density unevenness also is decreased in comparison to the case shown in FIG. 2C.

High Speed Printing Technologies

At the same time, a bidirectional printing is known as an example of a high speed printing technology. This printing method is a method in which, in a serial type printing apparatus, after performing printing by a forward direction scan of a print head, conveying a paper by a predetermined amount is performed, and a printing scan is also performed in a subsequent movement of the print head in a backward direction. With this printing method, in comparison to unidirectional printing, in which printing is performed in the forward direction scan but printing is not performed in the returning movement of the print head in the backward direction, double the printing speed or the throughput, by simple calculation, can be achieved.

The bidirectional printing can be used in both so-called one-pass printing, in which printing of a scan area having a length corresponding to an ejection port arrangement width of a print head is completed in a single scan of the print head, and the above-described multi-scan printing, in which printing of the scan area is completed with a plurality of scans between which a paper conveyance is performed. Thus by performing bidirectional printing with use of the multi-scan method, both high quality image printing and high speed printing can be realized.

However, it is also known that when bidirectional printing is performed with use of the multi-scan method, density unevenness (time interval unevenness) occurs due to a difference of a time intervals in the plurality of scans, between positions in a scan area.

FIG. 5 is a diagram for illustrating the time interval unevenness and shows an example where printing is completed in two scans (passes) in opposite directions to each other. In FIG. 5, when focusing attention on left and right end regions of a printing medium, a region in which a second printing is performed immediately after a first printing, and a region in which, after a first printing, a second printing is performed on elapse of a scan time corresponding substantially to two scans of forward or backward scan, appear alternately. As a result, at the left end region, a printing area 1 has high image density and a printing area 2 has low image density, and this density difference appears alternately. At the right end region, the printing area 1 has low image density and the printing area 2 has high in image density, and as in the left end, this density difference appears alternately. Also in each printing area, the density varies along a scan direction. For example, in the printing area 1, a left end side is high in density and the density decreases toward the right end side.

The above described phenomenon occurs due to differences in a time during which a precedently landing ink droplet permeates into an interior of a printing medium and becomes adsorbed into paper fibers or an ink receiving layer, etc., and then landing of a subsequent ink droplet is performed. If there is sufficient time for adsorption of the precedently landing ink into the paper fibers or the ink receiving layer, the subsequently landing ink droplet permeates gradually in a direction of gravity while seeking a portion into which it can become adsorbed comparatively smoothly. On the other hand, if there is not enough time for the precedently landing ink to become adsorbed into the paper fibers or the ink receiving layer, the subsequently landing ink droplet joins the precedently landing ink and permeates gradually in the gravity direction as a single aggregate of ink droplets. In the latter case, the precedently landing ink joins the subsequently landing ink before becoming adequately adsorbed by near a paper surface and becomes adsorbed at a lower portion. Consequently, the image density becomes comparatively low. In a case where printing of a secondary color is performed, the density unevenness appears as a color unevenness corresponding to the scan time intervals.

FIGS. 6A and 6B are diagrams for illustrating an occurrence of density unevenness in accordance with such ejection time intervals of ink droplets. A case where the ejection time interval of two ink droplets is long is illustrated in FIG. 6A, and a case where the ejection time interval of two ink droplets is short is illustrated in FIG. 6B. In FIG. 6A, a precedently ejected ink droplet lands on a printing medium and permeates and becomes fixed in an interior of the printing medium. After fixing takes place over a comparatively long time, a subsequently ejected ink droplet lands, permeates so as to get into under the precedently ejected ink, and becomes fixed below the precedently ejected ink. On the other hand, in the case shown in FIG. 6B, the precedently ejected ink droplet lands the printing medium and permeates into the interior of the printing medium. In this case, since the time until the subsequent ink droplet lands is short, the subsequently ejected ink droplet lands while the precedently ejected ink droplet is in the process of becoming fixed. Therefore, the unfixed ink of the precedently ejected ink droplet and the subsequently ejected ink droplet thus permeate as a single body of ink and becomes fixed finally. As result, the precedently ejected ink droplet is pushed downward by the subsequently ejected ink, the extent of permeation becomes lower below the paper surface and the density thus becomes lower. That is, as shown in FIGS. 6A and 6B, the depth of permeation of the precedently ejected ink droplet, in other words, the fixing position of the precedently ejected ink droplet differs, and the higher this position, the higher the image density. That is, the longer the time interval, the higher the density.

As explained above, in accordance with the difference in time intervals between a plurality of times of printing for performing printing on one region, a density difference occurs between the left end and the right end regions of a unit area for which printing is completed in the plurality of times of scan. Also as shown in FIG. 5, when such unit areas are adjacent to each other, regions of different density become adjacent alternately and this becomes recognized as a density unevenness (herein after, also referred to as "between-band unevenness"). In particular, the density difference is large and the between-band unevenness can be recognized conspicuously at the left and right end regions of the unit area.

As a technology for suppressing such time interval unevenness caused by the time difference of printing, there is a technology described in Japanese Patent Laid-Open No. 2003-34021. In this document is described a switching of a printing mode from bidirectional printing to unidirectional printing when a possibility of occurrence of density unevenness is high. Specifically, a printing area is divided into a plurality of areas in a main scan direction, and numbers of dots of black ink and color ink to be applied to each area are counted. When there are areas, in which threshold values are exceed for both black and color inks, the number of such areas is counted, and when this number of areas is no less than a predetermined number, it is deemed that the possibility of occurrence of time interval unevenness is high and switching to unidirectional printing is performed. The time interval unevenness that occurs at opposite end regions of a printed image can thus be suppressed. It is also described in the document that a width of printed image data, that is, a width of a range in which a print head scans is detected and when the width is small, it is deemed that a degree of time interval unevenness is small and switching to unidirectional printing is avoided even when the number of areas is no less than the predetermined number.

As another technology for suppressing time interval unevenness, Japanese Patent Laid-Open No. 2005-144868 describes that by making the number of passes of multi-scan increased when a printing width is long, the time interval unevenness between bands can be made inconspicuous. It is also described in the same document that the time interval unevenness can be made less recognizable by making the time interval unevenness be repeated at a high frequency. It is also described that when the printing width is long, the time interval unevenness can be reduced by raising a scan speed of a print head to shorten time intervals among multiple passes or by switching to unidirectional printing to make a printing time in each band the same.

However, in the case where switching to unidirectional printing is performed when the possibility of occurrence of density unevenness is high as described in Japanese Patent Laid-Open No. 2003-34021 and Japanese Patent Laid-Open No. 2005-144868, the significance of bidirectional printing, which is employed to achieve high speed of printing, becomes lost. Further, increasing the number of passes of multi-scan leads to lowering of an overall throughput. The change of scan speed requires a change of printing resolution.

Conventional methods of resolving time interval unevenness thus accompany comparatively large changes in printing operation or process details and cause various problems such as those mentioned above.

SUMMARY OF THE INVENTION

An object of the present invention is to provide an inkjet printing apparatus and an inkjet printing method that enable density unevenness, due to a difference in printing time intervals according to scans in bidirectional printing, to be resolved without causing changes in printing operation as much as possible.

In a first aspect of the present invention, there is an ink jet printing apparatus capable of performing bidirectional printing in which scans of a print head, on which a plurality of ejection ports for ejecting ink are arranged, are performed in forward and backward directions, and ink is ejected from the print head during the scans in the forward and backward directions so as to print an image on a printing medium, the apparatus comprising: a controller for executing the bidirectional printing by performing a plurality of scans of the print head, between which conveying of the printing medium is performed by a predetermined amount that is smaller than an arrayed range of the plurality of ejection ports, for each of unit areas adjacent to each other in a conveying direction of the printing medium, wherein the controller performs the conveying of the printing medium by an amount greater than the predetermined amount, between a last scan for printing one of the adjacent unit areas and a first scan for printing the other of the adjacent unit areas, and wherein a length of the unit area along the conveying direction is a length corresponding to a number of ejection ports that overlap among the plurality of scans for printing the unit area.

In a second aspect of the present invention, there is provided an ink jet printing apparatus capable of performing bidirectional printing in which scans of a print head, on which a plurality of ejection ports for ejecting ink are arranged, are performed in forward and backward directions, and ink is ejected from the print head during the scans in the forward and backward directions so as to print an image on a printing medium, the apparatus comprising: a controller for executing the bidirectional printing by performing a plurality of scans of the print head, between which conveying of the printing medium is performed by a predetermined amount that is smaller than an arrayed range of the plurality of ejection ports, for each of unit areas adjacent to each other in a conveying direction of the printing medium, wherein the controller performs the conveying of the printing medium by an amount of $(N-2q(k-1))\cdot p$ here, N is a number of the plurality of ejection ports, q is the predetermined amount, k is a number of the plurality of scans, and p is an array pitch of the plurality of ejection ports, and wherein a length of the unit area along the conveying direction is a length of $(N-q(k-1))\cdot p$ that corresponds to a number of ejection ports that overlap among the plurality of scans for printing the unit area.

In a third aspect of the present invention, there is provided an ink jet printing apparatus capable of performing bidirectional printing for a unit area of a printing medium in which printing, scans of a print head, on which a plurality of ejection ports for ejecting ink are arranged, are performed in forward and backward directions, and ink is ejected from the print head during the scans in the forward and backward directions so as to print an image on a printing medium, the apparatus comprising: a unit for differentiating a maximum ink applying amount depending on positions in a scan direction in the unit area.

In a fourth aspect of the present invention, there is provided an ink jet printing method of performing bidirectional printing in which scans of a print head, on which a plurality of ejection ports for ejecting ink are arranged, are performed in forward and backward directions, and ink is ejected from the print head during the scans in the forward and backward directions so as to print an image on a printing medium, the method comprising: a printing step of executing the bidirectional printing by performing a plurality of scans of the print head, between which conveying of the printing medium is performed by a predetermined amount that is smaller than an arrayed range of the plurality of ejection ports, for each of unit areas adjacent to each other in a conveying direction of the printing medium, wherein in the printing step, the conveying of the printing medium by an amount greater than the predetermined amount is performed between a last scan for printing one of the adjacent unit areas and a first scan for printing the other of the adjacent unit areas, and wherein a length of the unit area along the conveying direction is a length corresponding to a number of ejection ports that overlap among the plurality of scans for printing the unit area.

In a fifth aspect of the present invention, there is provided an ink jet printing method of performing bidirectional printing in which scans of a print head, on which a plurality of ejection ports for ejecting ink are arranged, are performed in forward and backward directions, and ink is ejected from the print head during the scans in the forward and backward directions so as to print an image on a printing medium, the method comprising: a printing step of executing the bidirectional printing by performing a plurality of scans of the print head, between which conveying of the printing medium is performed by a predetermined amount that is smaller than an arrayed range of the plurality of ejection ports, for each of unit areas adjacent to each other in a conveying direction of the printing medium, wherein in the printing step, the conveying of the printing medium by an amount of $(N-2q(k-1))\cdot p$ here, N is a number of the plurality of ejection ports, q is the predetermined amount, k is a number of the plurality of scans, and p is an array pitch of the plurality of ejection ports, is performed, and wherein a length of the unit area along the conveying direction is a length of $(N-q(k-1))\cdot p$ that correspond to a number of ejection ports that overlap among the plurality of scans for printing the unit area.

With the first aspect of the present invention, each unit area, the printing for which is completed in the plurality of scans, is printed by use of the ejection ports that overlap among the plurality of scans. In this case, the printing medium conveying amount between adjacent unit areas, that is, the amount, by which the printing medium is conveyed between the last scan for printing one of the adjacent unit areas and the first scan for printing the other unit area, is made to differ from the predetermined amount of printing medium conveying that is performed between the plurality of scans for printing each unit area. Specifically, the printing medium conveying amount between adjacent unit areas is made larger than the predetermined amount. Or, the printing medium conveying amount between adjacent unit areas is set to be $(N-2q(k-1))\cdot p$. The mutual printing time intervals between the plurality of scans, which intervals are in accordance with the position in the scan direction of the unit area, can thereby be made the same for all of the plurality of mutually adjacent unit areas.

Consequently, high image quality printing, without differences of density unevenness between unit areas, can be performed, and together with bidirectional printing, high speed printing and high image quality printing can be achieved at the same time.

With the second aspect of the present invention, in the multi-scan printing that completes the printing of each unit area by the plurality of scans of the print head, in which the forward scan and the backward scan are alternated, the maximum ink applying amounts differ according to the printing time intervals between the plurality of scans, which intervals in turn differ according to the positions in the scan direction of each unit area. The density differences according to the positions in the scan direction, which differences caused based on the printing time intervals between the reciprocal scans, can be canceled out by making the maximum ink applying amounts differ, and the density difference can thereby be reduced.

Further features of the present invention will become apparent from the following description of exemplary embodiments (with reference to the attached drawings).

BRIEF DESCRIPTION OF THE DRAWINGS

FIG. 22 is a diagram of an example of a table for setting the maximum value of ink applying amount according to the first embodiment of the present invention;

FIG. 23 is a diagram of a table for selecting a gamma correction table, for setting the wink applying amount, according to divided areas according to a modification example of the first embodiment; and FIG. 24 is a diagram of maximum values of ink applying amount that are set in the scan direction according to types of printing medium according to a second embodiment of the present invention.

DESCRIPTION OF THE EMBODIMENTS

Embodiments of the present invention will be described in detail below with reference to the drawings.

Configuration of a Printing apparatus

Figure 7:
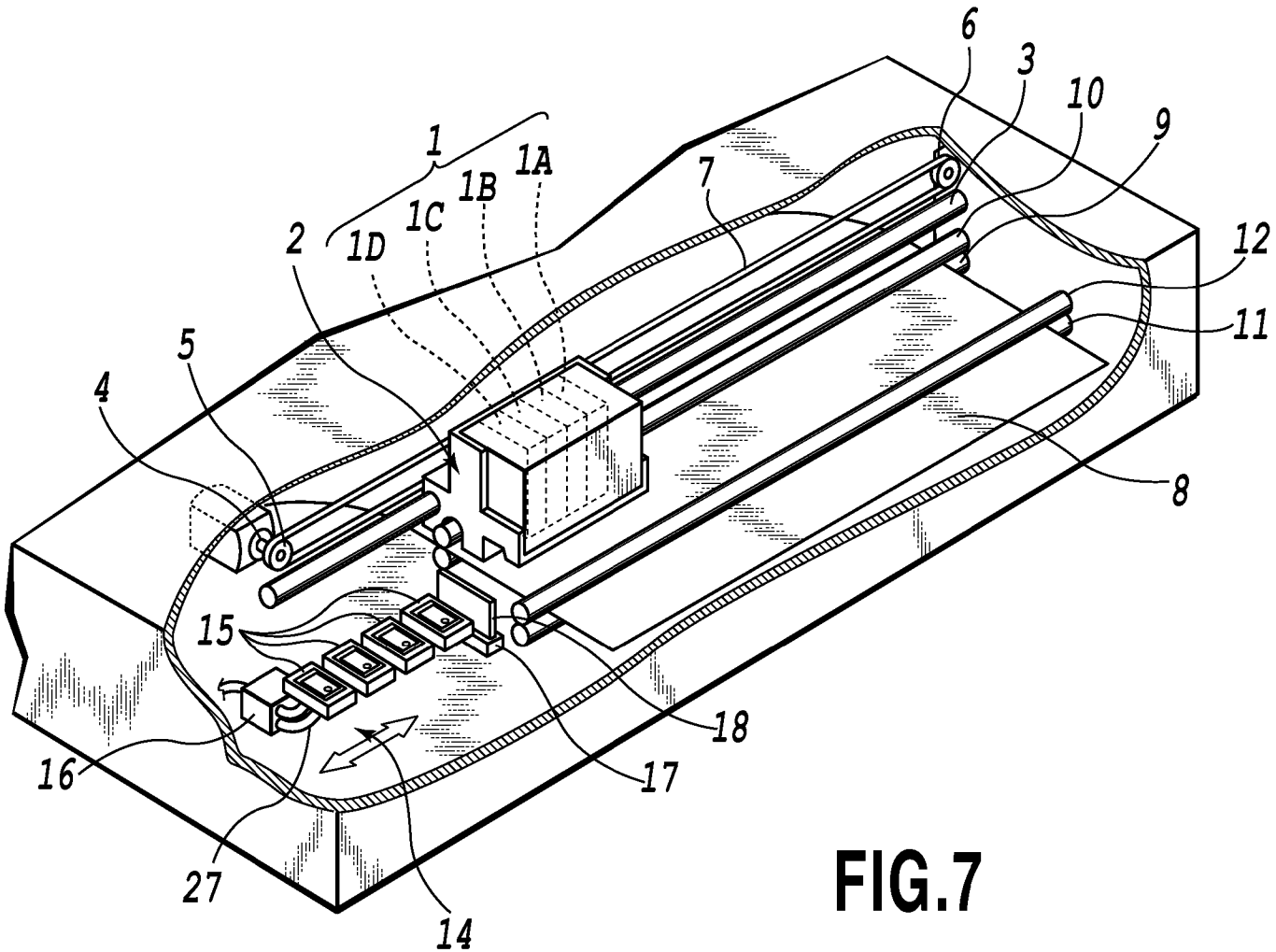
FIG. 7 is a schematic perspective view of a principal arrangement of an inkjet printing apparatus according to an embodiment of the present invention.

FIG. 7 is a schematic perspective view of a principal arrangement of an inkjet printing apparatus to which the present invention is applicable. In FIGS. 7, 1A, 1B, 1C, and 1D denote head cartridges, each of which has a print head and an ink tank configured integrally and is independently mounted on a carriage 2 in an exchangeable manner. Each of the head cartridges 1A to 1D is provided with a connector for receiving signals for driving the print head.

The print head portions of the head cartridges 1 eject inks of cyan (C), magenta (M), yellow (Y), and black (Bk), respectively, and the C, M, Y, and Bk inks are contained in the corresponding ink tank portions. Each of the head cartridges 1 is positioned and mounted exchangeably on the carriage 2, and the carriage 2 is provide with a connector holder (electrical connecting portion) for transmitting the driving signals, etc., to the respective print heads 1 via the connectors.

The carriage 2 is guided and supported by a guide shaft 3 disposed in a printing apparatus main unit, and is able to move in a main scan direction along the guide shaft 3. The carriage 2 is driven by a main scan motor 4 and via a motor pulley 5, a driven pulley 6, and a timing belt 7 and is controlled in position and movement.

A printing medium 8, such as a sheet of paper, a thin plastic plate, etc., is conveyed (sheet fed) by rotation of two sets of conveying rollers 9, 10 and 11, 12 so as to pass a position (printing portion) opposite to ejection port surfaces of the print heads 1. The conveyed printing medium has its rear surface held by a platen (not shown) so that a flat printing surface can be formed at the printing portion. The two conveying roller pairs (9/10 and 11/12) also serve a role of supporting the printing medium 8 from both sides of the printing portion so that a distance between the ejection port surfaces of the respective print heads 1, mounted on the carriage 2, and the printing medium 8 on the platen is maintained at a predetermined amount.

Although not shown in FIG. 7, an optical sensor is mounted on the carriage 2. The optical sensor applied in the present embodiment is a red LED or an infrared LED having a light emitting element and a light receiving element, and these elements are mounted at angles such that the elements are substantially parallel to the printing medium 8. The distance from the optical sensor to the printing medium 8 is determined according to characteristics of the optical sensor used, and with the present embodiment, it shall be deemed that this distance is set to approximately 6 to 8 mm. Furthermore, in order to avoid influences of mist due to ink ejection from the print heads 1, the optical sensor is preferably covered by a tubular member.

Figure 8:
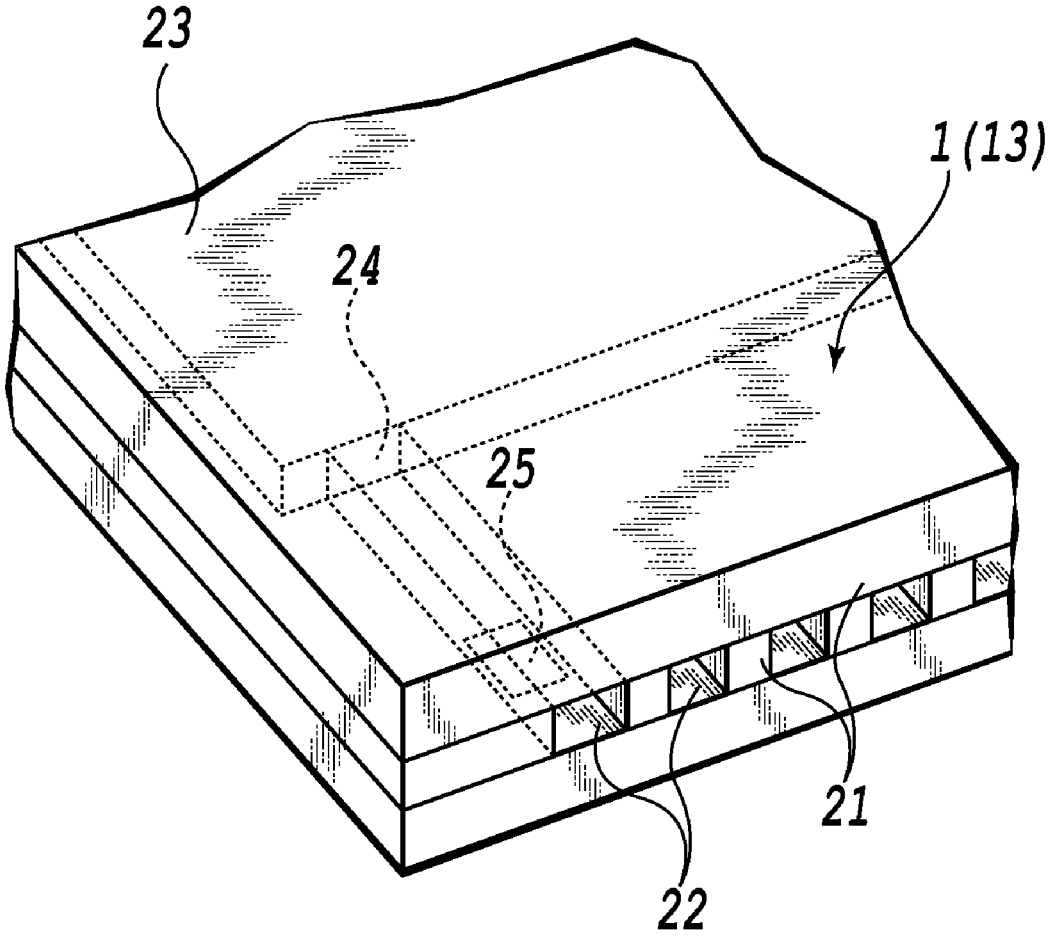
FIG. 8 is a schematic perspective view for describing a principal structure of an ink ejecting portion of a print head used in the device of FIG. 7.

FIG. 8 is a schematic perspective view for describing a principal structure of an ink ejecting portion 13 of the print head portion. In FIG. 8, an ejection port surface 21 is a surface that opposes the printing medium 8 with a predetermined gap (approximately 0.5 to 2 [mm] in the present embodiment) maintained in between, and a plurality of ejection ports (herein after, also referred to as "nozzles") 22 are formed at a predetermined pitch in the ejection port surface 21. The respective ejection ports 22 are put in communication with a common liquid chamber 23 via a plurality of flow paths 24, and a portion from the common liquid chamber 23 to the ejection ports 22 is constantly in a state of being filled intermittently with ink. On a wall surface of each flow path 24 is disposed an electro-thermal converter (a thermal resistor, etc.; herein after, also referred to as "ejection heater") 25 that generates energy for ejection of ink.

In an ejection process, a predetermined voltage is applied to each electro-thermal converter 25 based on an ejection signal. The electro-thermal converter 25 is thereby made to convert electrical energy to heat energy and the generated heat causes film boiling to occur in the ink inside the flow path 24. By a pressure of rapidly generated bubbles, the ink is pushed out to the ejection port 22 and a predetermined amount of the ink is ejected as a droplet. In the present embodiment, the inkjet print head, which thus ejects ink from the ejection port 22 using a pressure change resulting from growth and shrinkage of an air bubble caused by film boiling, is used.

In the present embodiment, each print head 1 is installed on the carriage 2 with the plurality of ejection ports 22 being in a positional relationship of being arrayed in a direction that intersects the scan direction of the carriage 2.

Construction of a Control Circuit

Figure 9:
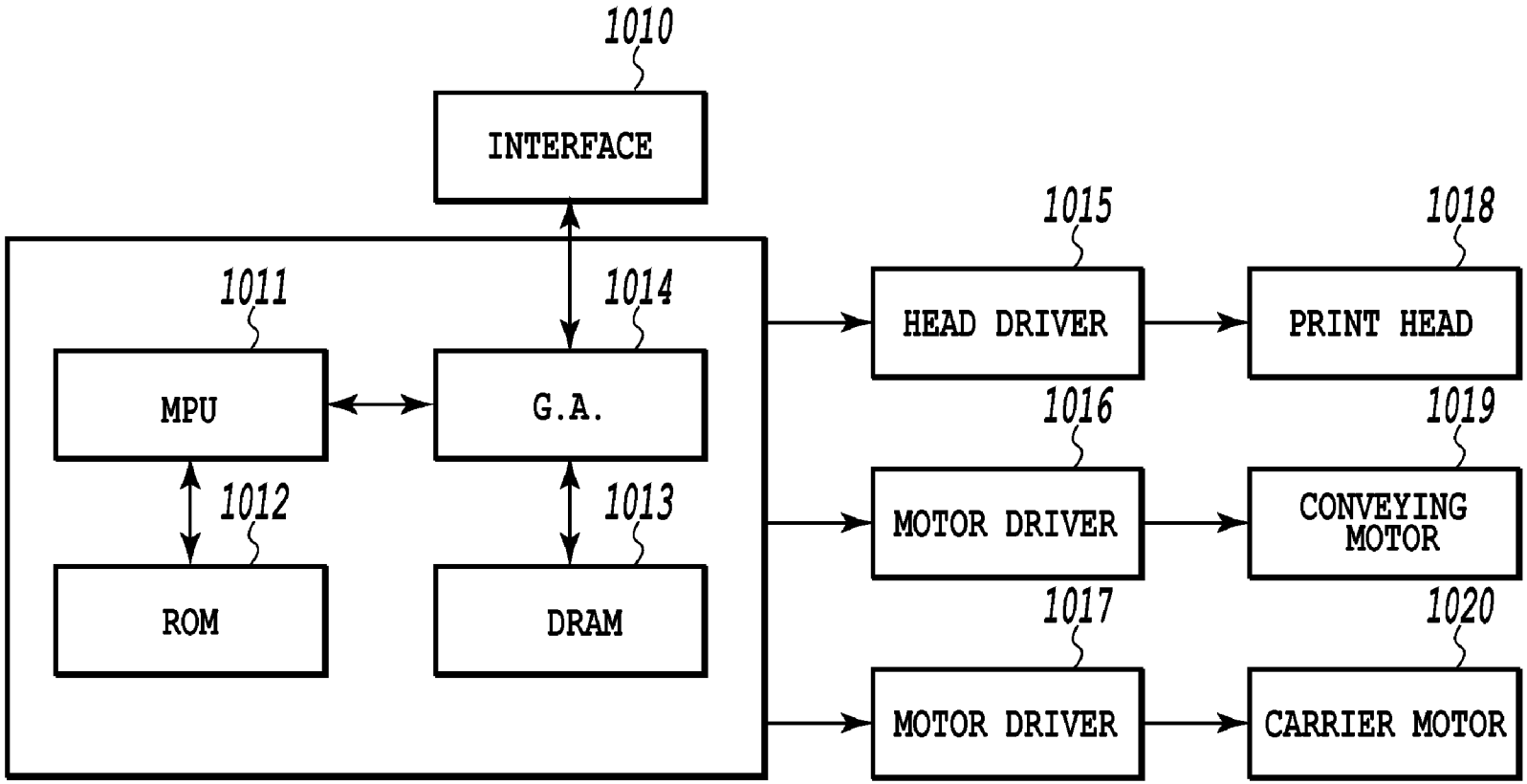
FIG. 9 is a block diagram of a control arrangement in the device.

FIG. 9 is a block diagram of a control configuration in the above-described inkjet printing apparatus of the present embodiment.

In FIG. 9, reference numeral 1010 denotes an interface for sending and receiving a printing signal, etc., to and from a host device, and 1011 denotes an MPU, respectively. Reference numeral 1012 denotes a program ROM and reference numeral 1013 denotes a dynamic RAM, respectively. The ROM 1012 stores a control program executed by the MPU 1011. The RAM 1013 stores various data (the printing signal, printing data supplied to a print head, etc.) and can also store a number of printed dots, for the number of times of exchange of a head cartridge, etc. Reference numeral 1014 denotes a gate array that performs control of supply of the printing data to the print head 1018 and also performs control of transfer of data among the interface 1018, the MPU 1011, and the RAM 1013. 1020 denotes a carrier motor, constituting a drive source for movement for scanning of the print head 1018, and reference numeral 1019 denotes a conveying motor, constituting a drive source for conveying of a printing sheet. Reference numeral 1015 denotes a head driver for driving the head to eject ink based on the printing data, and reference numerals 1016 and 1017 denote drivers for driving the conveying motor 1019 and the carrier motor 1020, respectively.

In the control configuration shown in FIG. 9, when the printing signal is input into the interface 1010, a process of converting the printing signal to printing data for printing is performed between the gate array 1014 and the MPU 1011. Also, driving of the motors 1018 and 1020 is controlled respectively via the motor drivers 1016 and 1017. Along with this, the respective print heads (portions) 1018 are driven according to the printing data of the respective colors transmitted to the head driver 1015 and the printing operation is thus performed.

Figure 10:
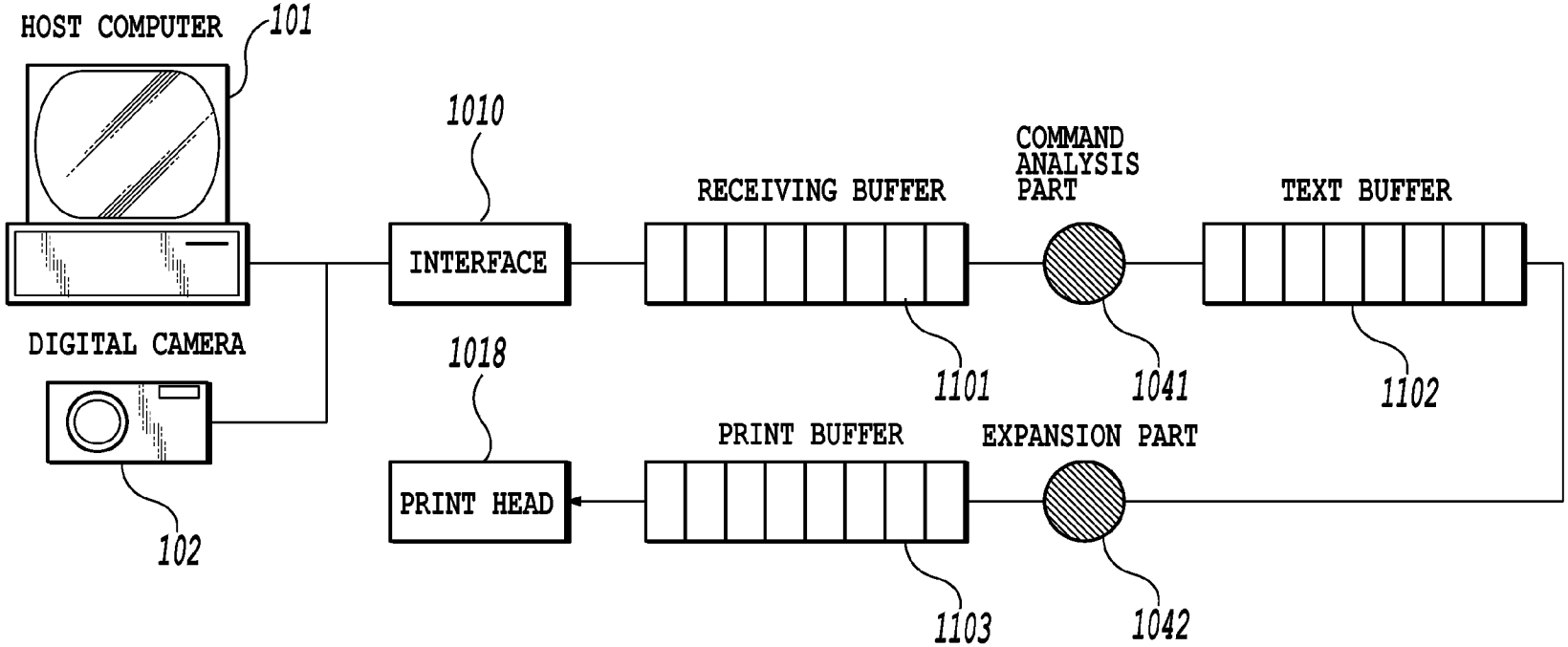
FIG. 10 is a diagram for describing a flow of printing data in the device.

FIG. 10 is a diagram for illustrating a flow of print data inside the printing apparatus according to the present embodiment, and each buffer shown in the figure is configured inside the DRAM 1013 (see FIG. 9).

Printing data from a host computer 101 or digital camera 102 are transmitted via the interface 1010 to a receiving buffer 1101 and stored therein. The receiving buffer 1101 has a capacity of several dozen kilobytes to several hundred kilobytes. The printing data stored in the receiving buffer 1101 undergo command analysis by a command analysis part 1041 and are thereafter transmitted to a text buffer 1102. In the text buffer 1102, the printing data are held in an intermediate form corresponding to a single line, and a process of adding a printing position, modification type, size, character code, font address, etc., of each character is performed. The text buffer 1102 differs in capacity according to device model and has a capacity corresponding to several lines in a case of a serial printer and a capacity corresponding to a single page in a case of a page printer. The printing data stored in the text buffer 1102 are decompressed by a expansion part 1042 and stored in a binarized state in a print buffer 1103. In a final stage, these data are transmitted as printing data to the print head for performing printing.

As shall be described later, in the present embodiment, the binary data stored in the print buffer are subject to a thinning process with use of a mask for each unit area for which printing is completed in a plurality of scans, to generate printing data for each of the plurality of scans by which the printing of the unit area is completed. With this process, a mask process for printing data corresponding to unused nozzles is also performed. In the above-described configuration, a mask pattern can be set after looking at the data in the state of being stored in the print buffer. Also instead of the above-described configuration, the text buffer does not have to be provided and the printing data stored in the receiving buffer may be decompressed at the same time as undergoing command analysis and then written into the print buffer.

Figure 11:
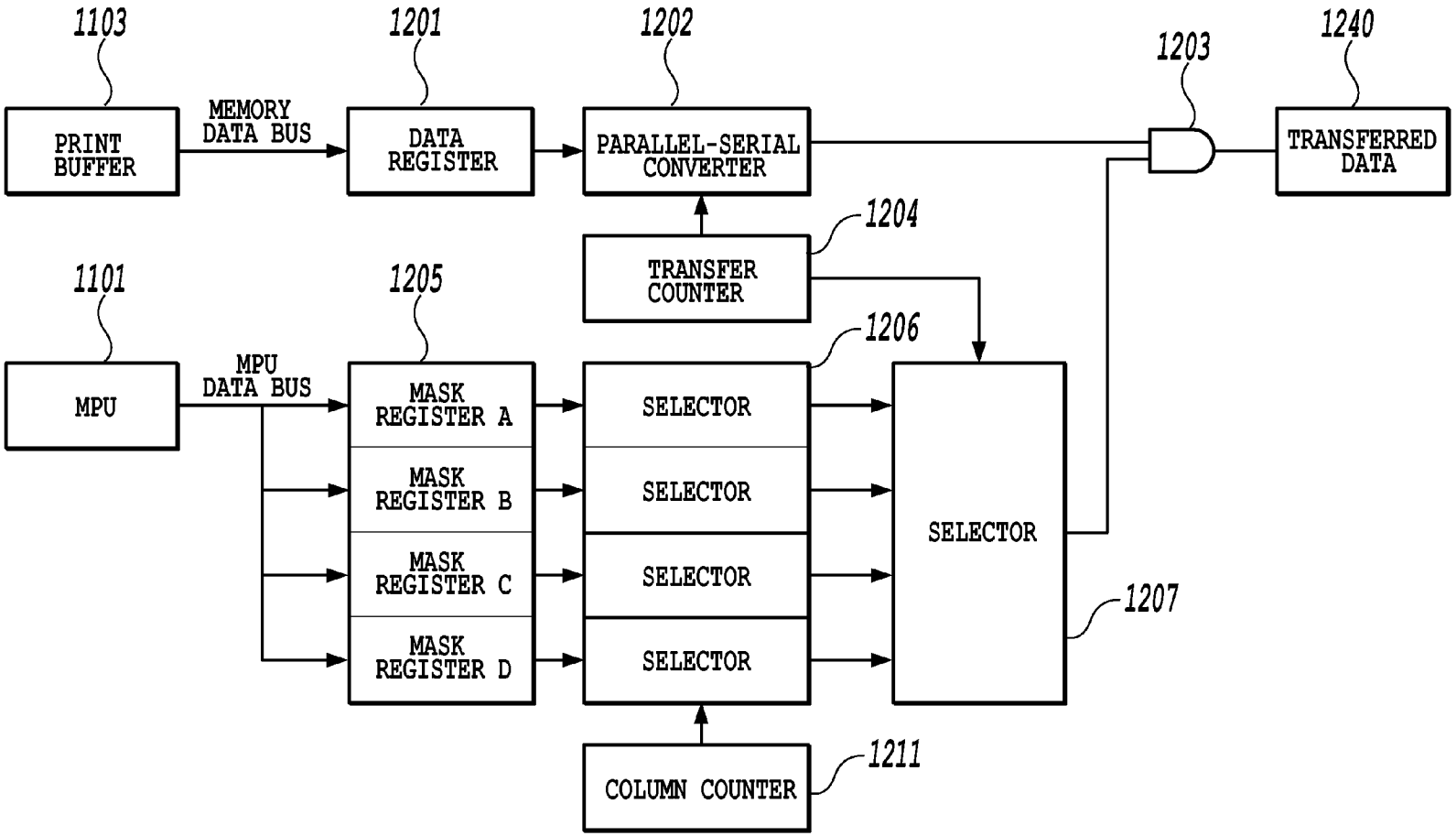
FIG. 11 is a block diagram of a data transfer circuit arranged inside a gate array shown in FIG. 9.

FIG. 11 is a block diagram of printing data generation for performing printing by a multi-scan method in the above-described configuration. In the figure, a data register 1201 is connected to a memory data bus and reads and temporarily stores the printing data stored in the print buffer 1103 in the memory 1013. In the present embodiment, during the reading of the printing data into the data register 1201, a non-use mask process is performed for unused nozzles. Specifically, reading of the printing data corresponding to the unused nozzles is inhibited. Obviously, the non-use mask process is not restricted to such a configuration. For example, a mask register, such as that described below, may be provided separately in correspondence to the unused nozzles.

In FIG. 11, reference numeral 1202 denotes a parallel-serial converter for converting the data stored in the data register 1201 to serial data, and reference numeral 1203 denotes an AND gate for making the serial data subjected to a mask process. Reference numeral 1204 denotes a counter for managing a number of data transfers.

Reference numeral 1205 denotes a register that is connected to an MPU data bus and is for storing mask patterns. Reference numeral 1206 denotes a selector for selecting column positions of the mask patterns, reference numeral 1207 denotes a selector for selecting line positions of the mask patterns, and reference numeral 1211 denotes a column counter for managing the column positions.

The data transfer circuit with the above configuration performs serial transfer of the printing data corresponding to the number of nozzles for the print head in accordance with the printing signal sent from the MPU 1011. Specifically, the printing data stored in the print buffer 1103 are temporarily stored in the data register 1201 and then converted into serial data by the parallel-serial converter 1202. The converted serial data are subject to the mask process by the AND gate 1203 and are thereafter transferred to the print head. The transfer counter 1204 counts the number of transfer bits and when a value corresponding to the number of nozzles is reached, the data transfer is ended.

The mask register 1205 is constituted of four mask registers A, B, C, and D and stores the mask patterns written by the MPU 1101. Each register stores a mask pattern of 4 vertical bits×4 horizontal bits. The selector 1206 selects mask pattern data corresponding to a column position by using a value of the column counter 1211 as a selection signal. The selector 1207 selects mask pattern data corresponding to a line position by using a value of the transfer counter 1204 as a selection signal. By using the mask pattern data selected by the selector 1206 and 1207, the mask is applied to the transferred data using the AND gate 1203.

Although with the present embodiment, a configuration with four mask registers is described, the number of mask registers may be another number. Also, although the transferred data to which the mask process is applied are directly supplied to the print head, a configuration where the data are stored once in the print buffer is also possible.

A bidirectional multi-scan method of a first embodiment of the present invention in the ink-jet printing apparatus with the configuration described above using FIGS. 7 to 11 will be described.

First Embodiment

Figure 12:
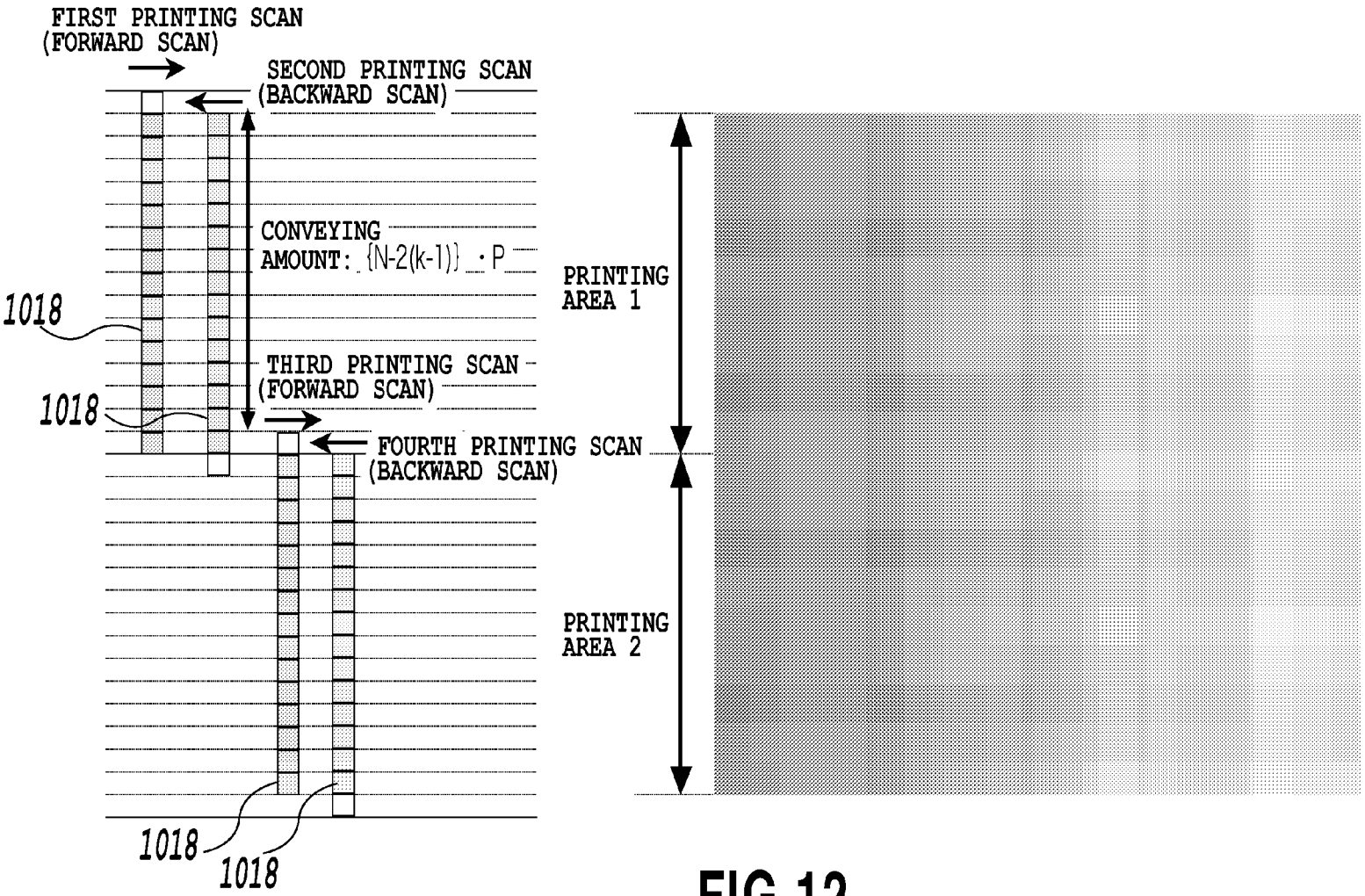
FIG. 12 is a diagram of an example of multi-scan printing by bidirectional scanning according to a first embodiment of the present invention.

Multi-Scan Printing Method with Control of Printing Time Interval Difference FIG. 12 is a diagram showing an example of multi-scan printing with bidirectional scanning according to an embodiment of the present invention. A multi-scan method described below can reduce mutual differences in density (between-band unevenness) between unit areas, for each of which printing is completed in a plurality of scans.

The figure shows an example where a print head having 16 nozzle blocks is used to complete printing of a unit area in two scans of forward and backward scans. In the present embodiment, one nozzle block is constituted of 16 nozzles. In the printing of the present embodiment, a conveying control, which differs from that of conventional multi-scan printing in a conveying amount of printing medium conveying performed in an interval between scans, is performed. Specifically, as shown in FIG. 12, with the present embodiment, after a first printing scan in a forward direction, conveying of an amount corresponding to a single nozzle block (×nozzle pitch) is performed, and then a second printing scan in a backward direction is performed to complete the printing of a "printing area 1" that is a unit area. After completion of the printing of this unit area, conveying of an amount corresponding to 14 nozzle blocks is performed. Then, third and fourth printing scans in the forward and backward directions respectively are performed to complete the printing of a "printing area 2" the same manner. Subsequently, respective two scans of the forward and backward directions are performed in a same manner to perform printing of each unit area.

In the above printing, a length (a length in a vertical direction in FIG. 12) of each of the unit areas, such as the "printing area 1," the "printing area 2," etc., the printing of which is completed successively, corresponds to 15 nozzle blocks. More specifically, in the respective scans, printing is performed for a length corresponding to 15 overlapping nozzle blocks of used nozzles, which result from masking of the printing data corresponding to one nozzle block at an upper end or a lower end of a nozzle column of the print head. For example, in the first printing scan of the forward direction, by which the "printing area 1" is printed, the printing data corresponding to one unused nozzle block at an uppermost end are masked. Specifically, when the printing data are read from the print buffer 1103, the printing data are read in units of all nozzles (16 blocks) of the print head. In this process, the printing data corresponding to the one nozzle block at the uppermost end are masked. That is, as previously mentioned above, reading of the printing data corresponding to the nozzle block at the uppermost end is forbidden. Actually, since the masked printing data are data for printing a unit area adjacent to an upper side of the "printing area 1," and printing thereof is completed already, these data have been deleted from the print buffer 1103. In the subsequent second printing scan, the printing data corresponding to the one unused nozzle block at a lowermost end among the 16 nozzle blocks are masked. In this case, a process of forbidding the reading of the printing data corresponding to the nozzle block at the lowermost end is likewise performed in the process of reading the printing data for 16 nozzle block units from the print buffer. Here, the printing data, corresponding to the nozzle block at the lowermost end, are data for printing the next "printing area 2" and are stored in the print buffer.

In addition to the above-described mask process for the unused nozzle blocks, a mask process using mask patterns for the multi-scan printing in which printing is completed in two scans, is performed, as described in FIG. 11. Specifically, mask patterns corresponding to the 15 nozzle blocks for printing each unit area are prepared for each of the two scans by which printing is completed, and thinned printing data are generated by using the mask patterns of each scan.

According to the above-described printing by the multi-scan method with control of printing time interval difference, in any of the unit areas, such as the "printing area 1, "printing area 2," etc., printing time intervals between scans are such that, at the same position in the scan direction, the time interval is the same. For example, in any unit area, a region for which the printing in the second scan is performed immediately after the printing in the first scan, is present at a right end and a region for which the printing in the second scan is performed after elapse of a printing scan time substantially corresponding to two scans, after the printing in the first scan, is present at a left end. Thus as shown in FIG. 12, in all unit areas (printing area 1, printing area 2, - - - ), an image density is high at the left end region and the image density decreases at the right end region. Consequently, differences in density between unit areas that are adjacent in the conveying direction of the printing medium, that is, between-band unevenness becomes more difficult to recognize.

Even with the above-described multi-scan method of printing, differences in printing time interval and thus differences in density according to position in the scan direction in each of the plurality of scans for completing printing cannot be resolved. For example, the density is high at the left end region of a unit area and the density becomes lower toward the right end region. This density difference or variation can be reduced by control of ink applying amount according to position in the scan direction according to an embodiment of the present invention to be described later. Both the density unevenness between unit areas and the density variation in the scan direction in each unit area can thereby be reduced.

Figure 13:
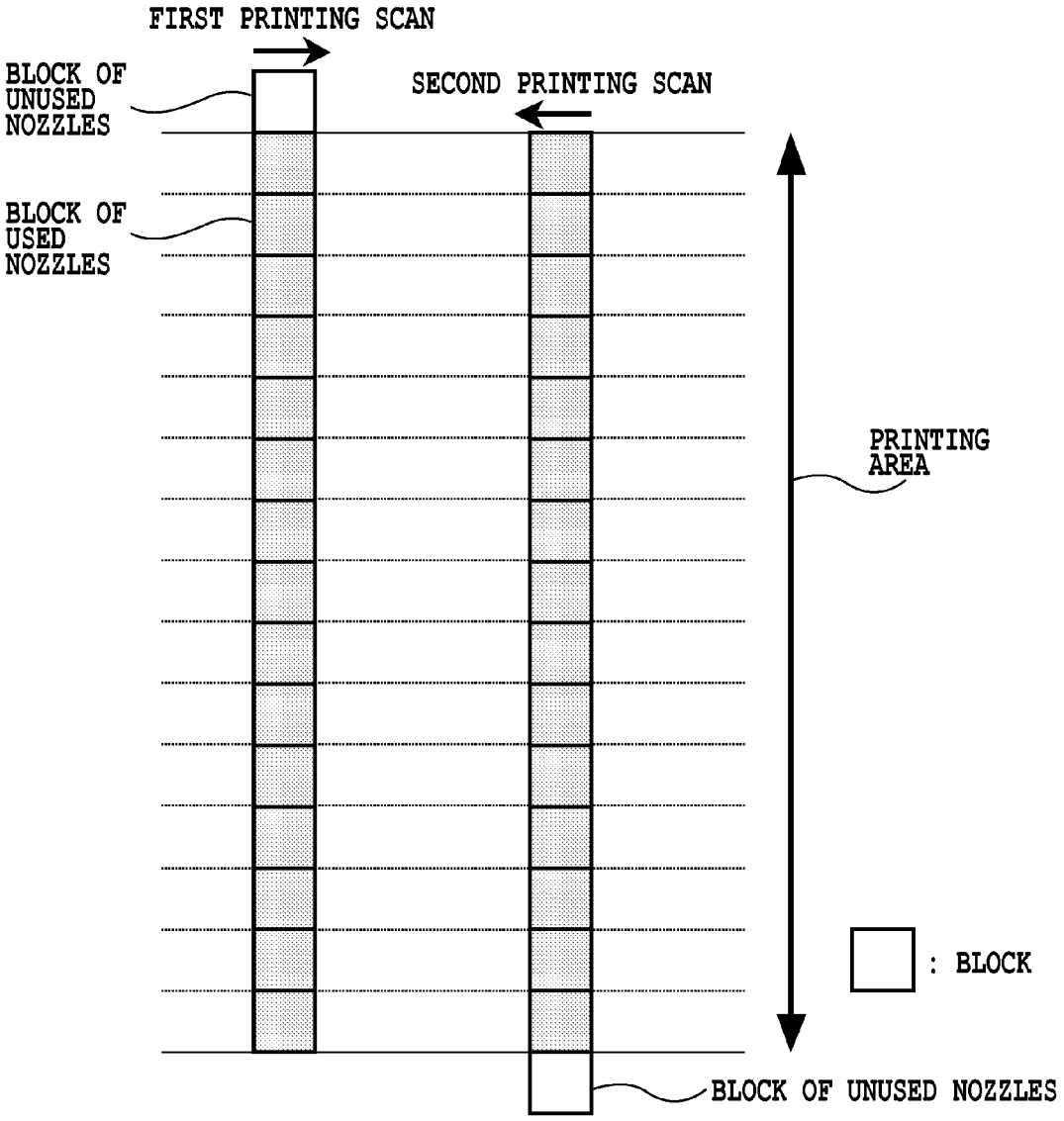
FIG. 13 is a diagram for describing details mainly of use/non-use of nozzle blocks in the printing by the embodiment described in FIG. 12.

FIG. 13 is a diagram for describing details mainly of use/non-use of nozzle blocks in the printing in the embodiment described in FIG. 12. As shown in FIG. 13, the print head is constituted of 16 nozzle blocks. Each block is constituted of 16 nozzles and the print head has a total of 256 nozzles. As shown in FIG. 12, in the first printing scan, one block at the uppermost end is set as the unused nozzles. The nozzles of the other 15 blocks are used. Next in the second printing scan, the non-use mask is set at one block at the lowermost end and the nozzles thereof are set to be unused. The nozzles of the other 15 blocks are used for printing. In an interval between the first printing scan and the second printing scan, an amount of conveying the printing medium in the conveying direction (sub-scan direction) corresponds to one block. That is, an amount corresponding to the length (pitch) of the unused nozzle set in printing scan is set to the conveying amount between scans for completing the printing of a unit area. On the other hand, the conveying amount in transiting to another unit area corresponds to 14 nozzle blocks as mentioned above.

Also, thinning masks which can be complemented by each other in the two printing scans, are associated with the used nozzles in each scan. The thinning masks are not restricted in detail and may, for example, be checker pattern and complementary checker pattern masks or may be random masks.

As described above, in performing printing of the same printing area (unit area), the printing of which is completed in a plurality of scans, the non-use mask is set in each printing scan with respect to the print head nozzles used in each scan and printing medium conveying of the amount related to the unused nozzles is performed. Printing, with the density unevenness between unit areas adjacent to each other in the conveying direction being reduced, can thereby be performed without generating a time interval difference between respective printing scans. That is, since, between adjacent unit areas, the time interval between printing scans can be made substantially the same for the same position in the scan direction, high image quality printing without between-band unevenness can be achieved and consequently, realization of high speed printing and high image quality printing at the same time is enabled.

Although with the present embodiment, a description of nozzle control and mask control in block units, with 16 nozzles per block, was provided, the present invention is not restricted to control in block units and the number of nozzles in a block is not restricted to the above. For example, even if the unused nozzle is one nozzle, the same concepts can be applied. The same effects can be obtained as long as the relationship of the number of non-use masks and the printing medium conveying amount is maintained in the printing scan.

However, in a case of a print head with a comparatively large number of nozzles, when ejection is performed from all nozzles simultaneously, a large voltage variation occurs and ejection tends to become unstable due to influences of ejections of adjacent nozzles, etc. Generally, ejection is performed with a drive cycle for performing printing of a single column being divided into a plurality of drive timings. For example, for a single column, the drive cycle is divided into 16 and simultaneous driving of nozzles is performed in 16-nozzle intervals. In the case of using the print head shown in FIG. 13, ejection is performed from 16 nozzles simultaneously and this is repeated 16 times to complete ejections of the number of nozzles of the print head. Such drive timings can be set according to a specific sequence (drive pattern). In a case where such print head driving method is to be used, one block corresponds to one cycle in the drive pattern of drive timing. In printing within one raster, the drive patterns are preferably the same in cycle, and if there is a cycle deviation, this gives rise to a slight impact deviation that may become a cause of texture. Thus more preferably, the present invention is applied in drive pattern units.

(Pass Number Dependence of Density Unevenness)

Figure 14:
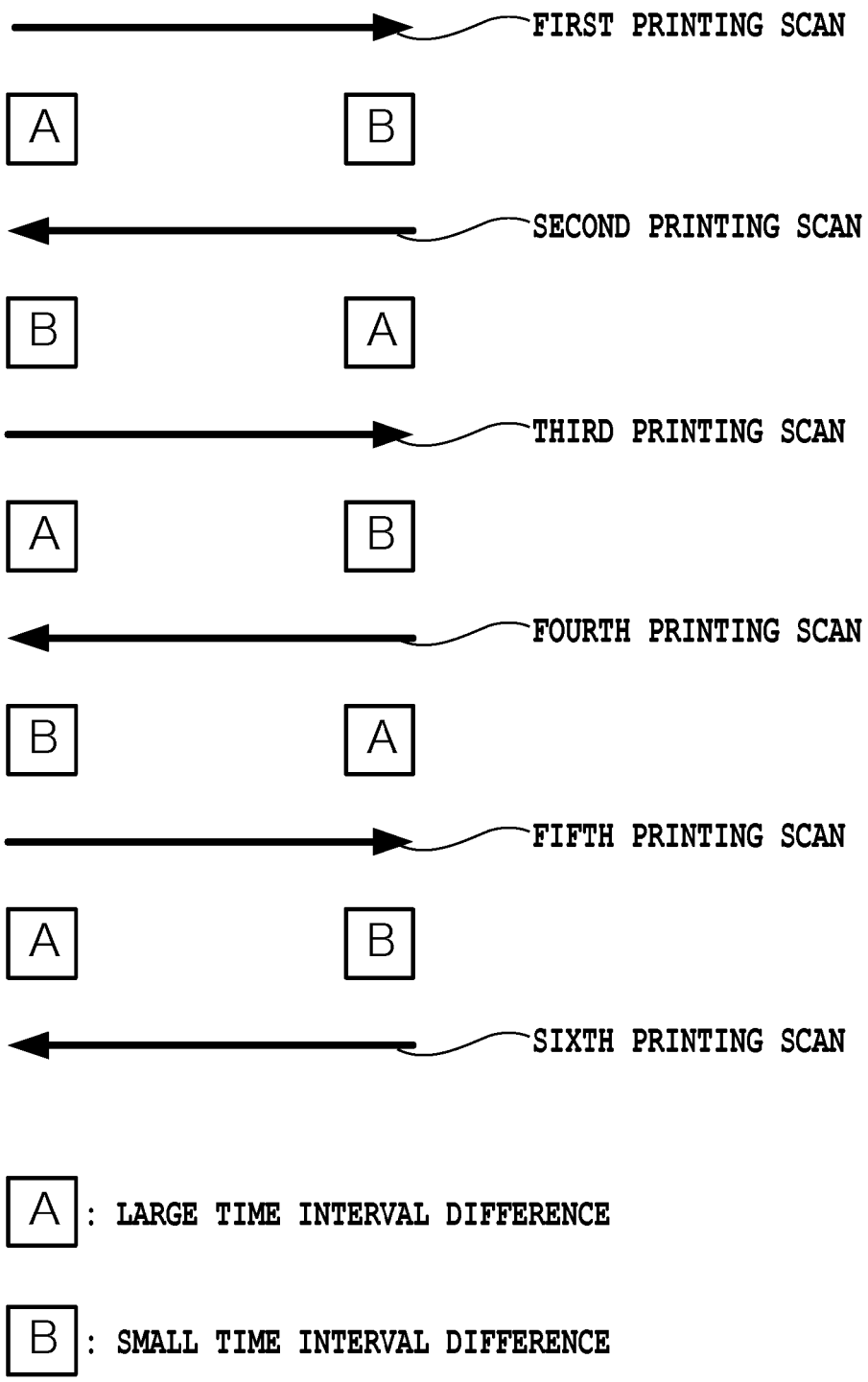
FIG. 14 is a diagram for describing that between-band unevenness due to a difference between forward and return printings differs between a case of an even number of passes and a case of an odd number of passes.

The between-band unevenness due to time intervals between forward and backward printings, which has been described up to now, becomes significant in multi-scan of an even number of passes but does not become so significant in a case of odd number of passes. FIG. 14 is a diagram for describing this situation and is for describing the time intervals between the respective printing scans.

In FIG. 14, in a case of normal two-pass multi-scan printing, one unit area for which printing is completed in two passes is printed in a first printing scan and a second printing scan, and a subsequent unit area is printed in the second printing scan and a third printing scan. When focusing attention on a left end region of the printing medium, whereas the printing time interval between the first printing scan and the second printing scan is large (A), the printing time interval is small (B) between the second printing scan and the third printing scan by which printing of the next unit area is completed. In this case, the printing time interval differs between unit areas that are adjacent in the conveying direction of the printing medium and the between-band unevenness becomes conspicuous.

On the other hand, in a case of normal three-pass multi-scan printing, one unit area for which printing is completed in three passes, is printed in a first printing scan to a third printing scan, and a subsequent unit area is printed in a second printing scan to a fourth printing scan. When focusing attention on a left end region of the printing medium, it can be seen that in the unit area for which printing is completed by the first printing scan to the third printing scan, the printing time interval between the first printing scan and the second printing scan is large (A) and the printing time interval between the second printing scan and the third printing scan is small (B). A case where the printing time interval is large (A) and a case where the printing time interval is small (B) are thus present equivalently. In the adjacent unit area for which printing is completed by the second printing scan to the fourth printing scan, the printing time interval between the second printing scan and the third printing scan is small (B) and the printing time interval between the third printing scan and the fourth printing scan is large (A). Thus, a case where the printing time interval is large and a case where the printing time interval is small are present equivalently in this unit area as well. Therefore, for the three-pass multi-scan printing, since the numbers of the large and small printing time intervals are equivalent between adjacent unit areas, density unevenness due to the printing time intervals is inconspicuous.

Likewise, in a case of four-pass multi-scan printing in which printing on a unit area is completed in four printing scans, the printing time intervals A, B, and A (herein after, denoted as "A+B+A") are present at the left end of the printing medium in one unit area. This becomes B+A+B in the next, adjacent unit area. Thus in the case of four-pass multi-scan printing, the numbers of large and small printing time intervals differ between adjacent unit areas and the density unevenness due to the printing time intervals becomes conspicuous. On the other hand, in a case of five-pass multi-scan printing, the printing time intervals are A+B+A+B for one unit area and are B+A+B+A for the next, adjacent unit area. Thus with the five-pass multi-scan, the numbers of large and small printing time intervals are the same among adjacent unit areas. Consequently, density unevenness due to the printing time intervals in reciprocal printings is inconspicuous.

As described above, in the case of an even number of passes, the between-band unevenness becomes conspicuous and in the case of an odd number of passes, the between-band unevenness becomes inconspicuous. Thus with the present embodiment, the multi-scan printing method with control of printing time interval difference, described in the first embodiment, and the normal multi-scan printing method are switched according to the number of passes taken to complete printing.

(Switching Process)

Figure 15:
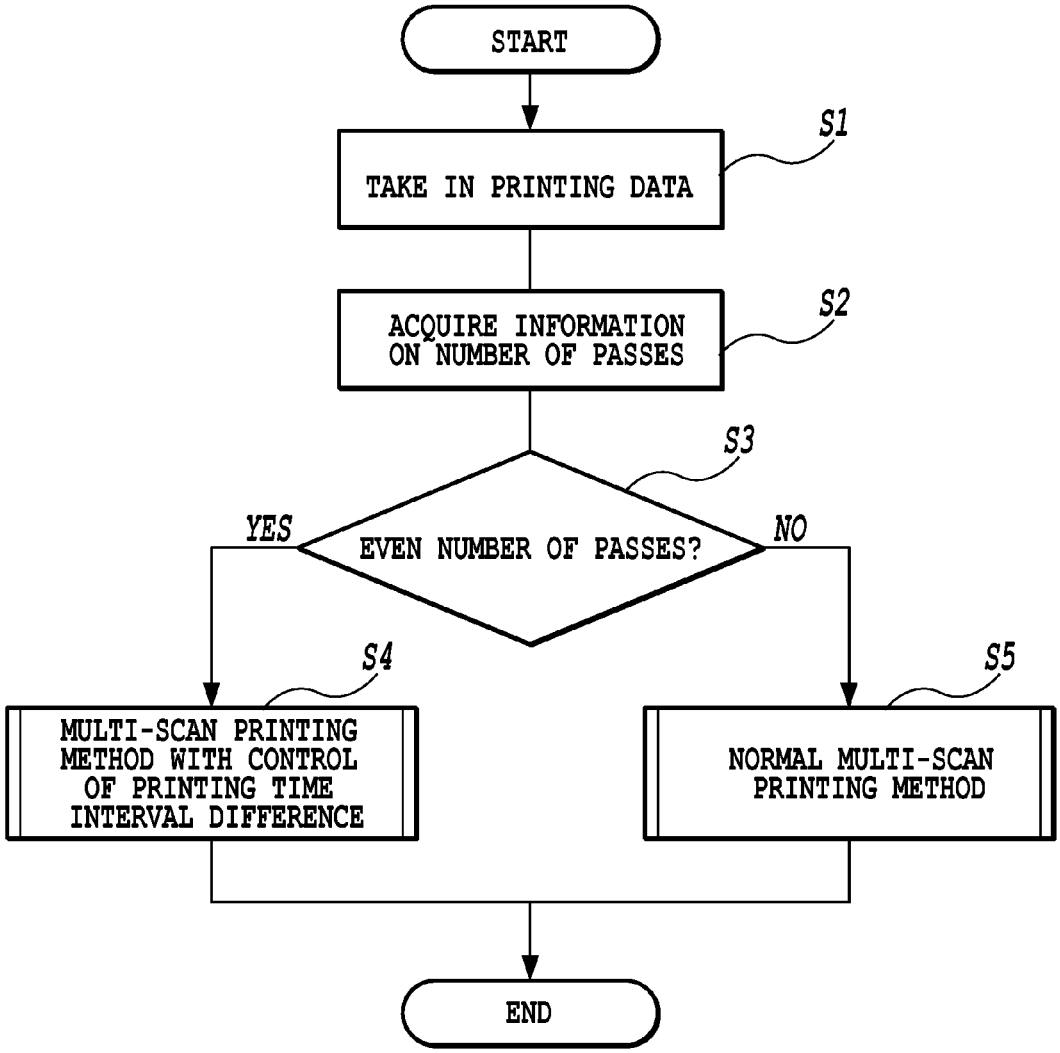
FIG. 15 is a flowchart for describing a printing process accompanying switching of a multi-scan printing method according to a second embodiment of the present invention.

FIG. 15 is a flowchart for describing a printing process with switching of the multi-scan printing method according to the present embodiment. In FIG. 15, first, in step S1, printing data are taken in. Then in step S2, pass information is acquired. This is performed by referencing information on printing quality, printing medium, etc., included in the printing data and referencing a combination table which the printing apparatus has stored in a ROM or other storage device in advance, and judging the number of passes of the multi-scan printing. The pass number information may be directly added into the printing data.

Then in step S3, whether the number of passes is an even number or another number, that is, an odd number is judged based on the pass number information. In the case of an even number of passes, the multi-scan printing method with control of printing time interval difference, described in the first embodiment, is set and executed in step S4. Thus, whereas in multi-scan printing with an even number of passes, the between-band unevenness becomes conspicuous, the generation of the between-band unevenness can be reduced by the above-described multi-scan printing method with control of printing time interval difference. Meanwhile, if in step S3, it is judged that the number of passes is not even, a normal multi-scan printing method is set and executed in step S5.

Thus with the present embodiment, the multi-scan printing method with control of printing time interval difference is not applied at all times but is applied as necessary. Although application of this printing method causes lowering of throughput compared to normal multi-scan with the same number of passes, this lowering of throughput can be reduced as much as possible by the above-described switching.

In the present embodiment, one type of multi-scan printing method is set for a single piece of printing data. Although normally, a single number of passes is set for a single printing job, in a case where, for example, the number of passes is switched according to the type of printing data in each printing area, the multi-scan printing method may be set in each printing area in accordance with the number of passes set.

Although in the present embodiment, the multi-scan printing method is switched between even number of passes and odd number of passes, the multi-scan printing method with control of printing time interval difference may be set just in a case of two-pass printing, with which the influence of time interval of the printing scan interval is large. In this case, a judgment of whether the number of passes is two is made in step S3 of FIG. 15.

Figure 16:
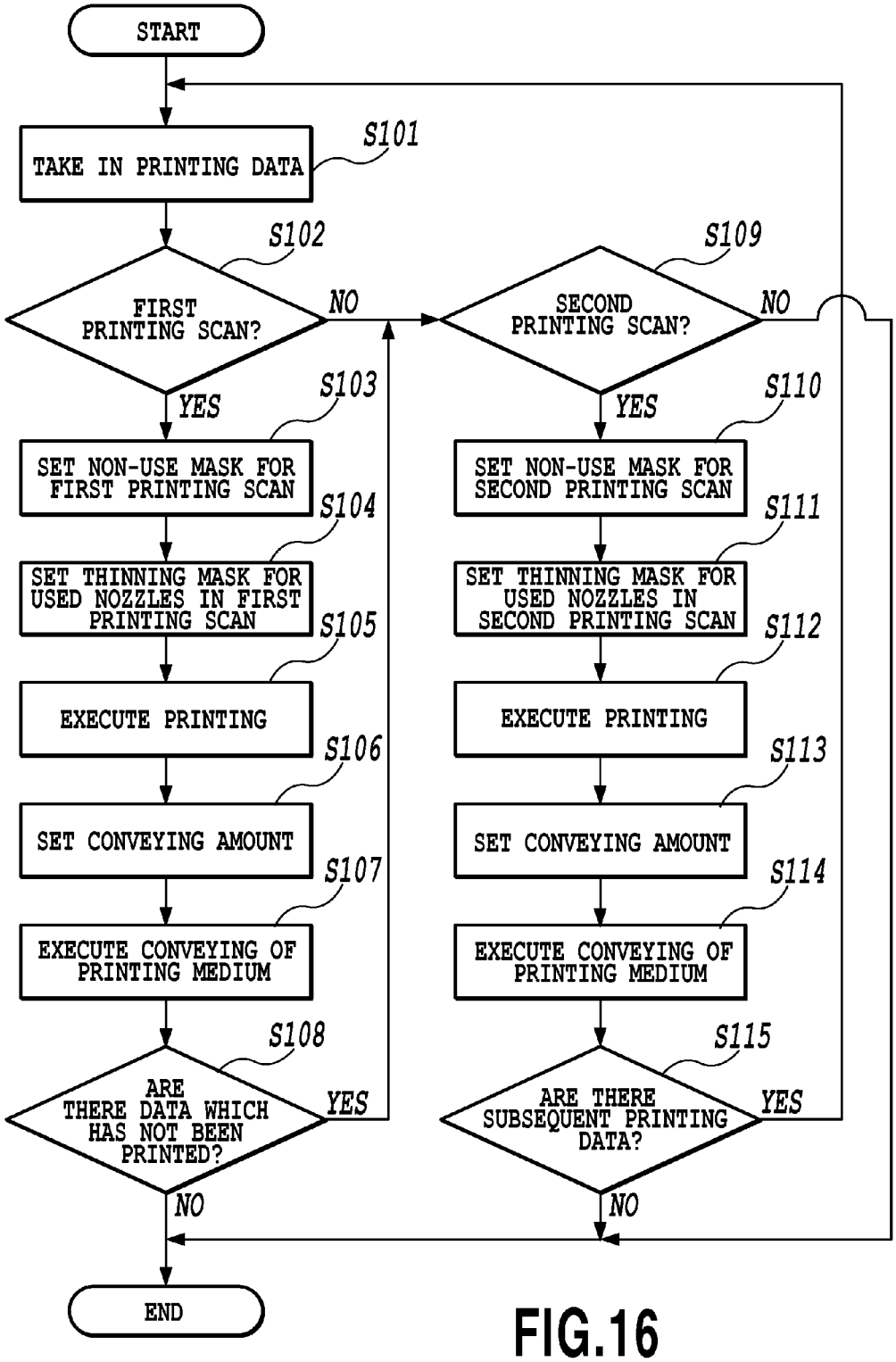
FIG. 16 is a flowchart of a control process of performing, in relation to the switching, a multi-scan printing method with control of printing time interval difference described in the first embodiment.

FIG. 16 is a flowchart of a control process of performing the multi-scan printing method with control of printing time interval difference described above. The process shown in FIG. 16 is that for a case of performing two-pass multi-scan printing.

In FIG. 16, first in step S101, printing data are taken in. Then in step S102, it is judged whether the present scan is a first printing scan or a different printing scan.

If in step S102, it is judged that the present scan is the first printing scan, then on-use mask for the first printing scan is set in step S103 as described in FIGS. 12 and 13. Specifically, printing data are specified in association with nozzles or a nozzle block and a setting is made so that these printing data are not read.

Next in step S104, a thinning mask for the first pass of the two-pass multi-scan is set for the nozzles used in the first printing scan. The thinning mask set here is in a complementary relationship with a thinning mask used in the printing scan of the second pass performed on one unit area for which printing is to be completed. The printing in the first scan is then performed in step S105. Then in step S106, the printing medium conveying amount after the first printing scan, which was described in FIG. 12, is set and in step S107, conveying of the printing medium is executed in accordance with the conveying amount.

Next, in step S108, it is judged whether there are printing data that are in the middle of printing. Here, "in the middle of printing" refers to a state where the multi-scan printing for one unit area is not completed. If in step S108, it is judged that there are no printing data in the middle of printing, the present sequence is ended. If in step S108, it is judged that there are printing data in the middle of printing and it is judged in step S102 that the present scan is not the first printing scan, it is judged in step S109 whether the present scan is a second printing scan or a different printing scan.

If in step S109 it is judged that the present printing scan is the second printing scan, the non-use mask for the second printing scan is set in step S110. Here, as described in FIGS. 12 and 13, the non-use mask set for the second printing scan is set for different nozzle positions with respect to the non-use mask for the first printing scan. Then in step S111, the thinning mask for performing printing is set for the nozzles used in the second printing scan. The thinning mask set here is in the complementary relationship with the thinning mask used in the first printing scan. Printing of the second scan is then executed in step S112, and in accordance with the printing medium conveying amount after the second printing scan set in step S113, conveying of the printing medium is executed in step S114. The conveying amount set here is determined in relation to the numbers of the used nozzles and the unused nozzles. Then in step S115, it is judged whether or not there are subsequent printing data. If in step S115, it is judged that there are subsequent printing data, step S101 is entered, image data are taken in again and the present process is repeated. As a matter of course, in this case, the first printing scan and the second printing scan shown in FIG. 16 correspond to the third printing scan and the fourth printing scan described in FIG. 12. That is, in the above description, the two scans by which printing of a unit area is completed are referred to respectively as the first printing scan and the second printing scan. If in step S115, it is judged that there are no subsequent printing data, the present process is ended.

Although the multi-scan printing method with control of printing time interval difference described in the respective embodiments above concerns two-pass printing, the present invention is obviously not restricted in application to two passes. The multi-scan printing method with control of printing time interval difference of three passes, four passes, or any other number of passes of no less than three may be executed. In this case, whereas with an even number of passes, the printing of the respective unit areas begins with a scan of a fixed direction of forward or return, with an odd number of passes, an only point of difference is that the forward and backward scans are alternated at the beginning of printing of each unit area.

Figure 17:
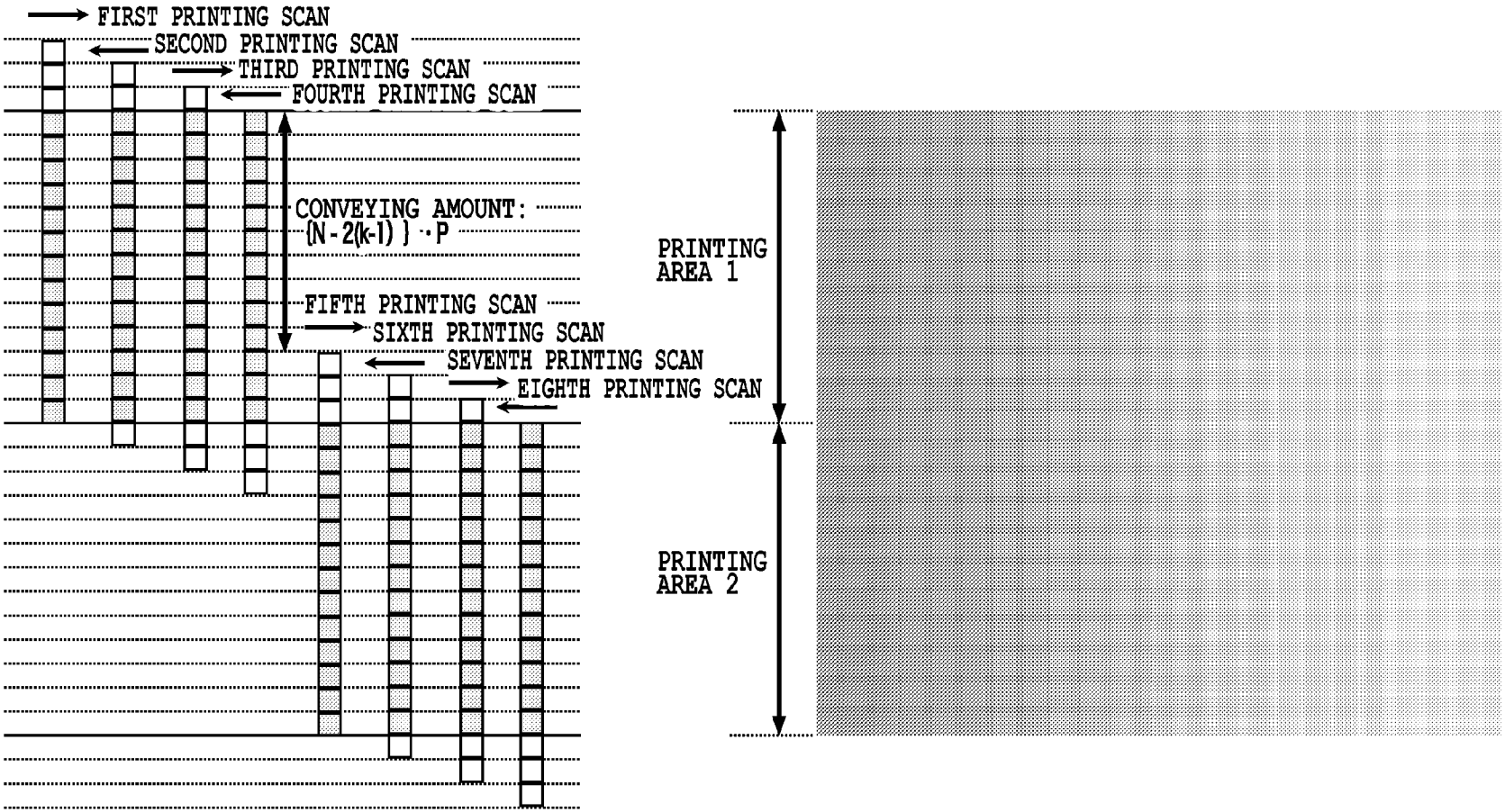
FIG. 17 is a diagram for describing a four-pass multi-scan printing method with control of printing time interval difference according to an embodiment of the present invention.

FIG. 17 is a diagram for describing a four-pass multi-scan printing method with control of printing time interval difference and is the same type of figure as FIG. 12. In the present example, the print head having 16 nozzle blocks is used as in the example shown in FIG. 12, and printing of a unit area is completed by four scans in a reciprocating manner. One nozzle block is constituted of 16 nozzles.

As shown in FIG. 17, after a first printing scan in a forward direction, conveying of a printing medium is performed by an amount corresponding to one nozzle block (×nozzle pitch) A second printing scan in a backward direction is then performed and thereafter, conveying of an amount corresponding to one nozzle block is likewise performed. A third printing scan in the forward direction is performed, conveying of an amount corresponding to one nozzle block is likewise performed thereafter, and by lastly performing a fourth printing scan in the backward direction, printing of a "printing area 1" as a unit area is completed. After completion of the printing of this unit area, conveying of an amount corresponding to ten nozzle blocks is performed. Then, by performing a fifth printing scan in the forward direction, sixth printing scan in the backward direction, seventh printing scan in the forward direction, and eighth printing scan in the backward direction, printing of a "printing area 2" is completed in a likewise manner. Subsequently, four scans of the reciprocal manner are performed in the same manner to perform printing of each unit area.

In the above-described printing, a length (a length in a vertical direction in FIG. 17) of each of the unit areas, such as the "printing area 1," the "printing area 2," etc., the printing of which is completed successively, corresponds to thirteen nozzle blocks. That is, in the first scan for printing the "printing area 1," three nozzle blocks at an upper end are set to be unused nozzle blocks. Then in the subsequent second scan, two nozzle blocks at the upper end and one nozzle block at a lower end are set to be unused one. Furthermore in the third scan, one nozzle block at the upper end and two nozzle blocks at the lower end are set to be unused. Lastly in the fourth scan, three nozzle blocks at the lower end are set to be unused. As a result of providing unused nozzle blocks, each unit area is printed across the length corresponding to thirteen nozzle blocks which is the portion of overlap of the nozzles used in each scan.

As a matter of course, in addition to the mask process for the unused nozzle blocks, a mask process using mask patterns for performing the multi-scan printing, with which printing is completed in four scans, is also performed.

The above-described printing medium conveying amount, etc., in the multi-scan printing of the respective embodiments can be generalized as follows. When a unit area is completed in k scans, that is, in a case of multi-scan of k passes, the conveying amount of a conveyance performed between respective two consecutive scans of the k scans is set to correspond to one nozzle block in the respective embodiments described above. In this case, the conveying amount for the process of transiting to the next unit area when a print head having N nozzle blocks is used is expressed as: $(N-2(k-1))\cdot p$. Here, p is the conveying amount corresponding to one nozzle block. Even when nozzles are used as the unit of conveying instead of nozzle blocks, the same formula can be used to express the conveying amount by using the array pitch of nozzles as p above. The same clearly applies to the amounts described below as well. The total masked amount of the printed data corresponds to k−1 nozzle blocks in any scan among the k scans, and the amount of unused nozzle blocks at the upper end in an m-th scan corresponds to $(k-1)-(m-1)$ blocks. Furthermore, the number of used nozzles, that is, the number of nozzles that overlap among the k scans corresponds to $N-(k-1)$ blocks.

If the conveying amount between respective two consecutive scans of k scans is then made to correspond not to one nozzle block but more generally to q nozzle blocks, the above relationship becomes as follows. The conveying amount for the process of transiting to the next unit area is expressed as: $(N-2q(k-1))\cdot p$. The total masked amount of the printed data corresponds to q (k−1) nozzle blocks in any scan among the k scans, and the amount of the unused nozzle blocks at the upper end in the m-th scan corresponds to $q((k-1)-(m-1))$ blocks. Furthermore, the number of used nozzles, that is, the number of nozzles that overlap among the k scans corresponds to $N-q(k-1)$ blocks.

For example, in the case shown in FIG. 12, let the conveying amount between the two scans (the first scan and the second scan) correspond to eight nozzle blocks (q=8), which is half of the nozzle column of the print head, as in normal multi-scan. In this case, by the above formula, the conveying amount (between the second scan and the third scan) for transiting to the adjacent "printing area 2" corresponds to zero nozzle blocks. Also in the case shown in FIG. 17, let the conveying amount among the four scans (each of the first scan to the fourth scan) correspond to four nozzle blocks (q=4), which is one-fourth of the nozzle column of the print head, as in normal multi-scan. In this case, by the above formula, the conveying amount (between the fourth scan and the fifth scan) for transiting to the adjacent "printing area 2" corresponds to −8 nozzle blocks and thus conveying in a reverse direction is performed in this case. In normal multi-scan printing, generally, the conveying amount, $(N-2q(k-1))\cdot p$ for transiting to a first scan for printing the next unit area is the same as the conveying amount $q\cdot p$ between the plurality of scans for completing each unit area. On the other hand, in the method of present embodiment, these conveying amounts differ from each other in many cases. In actuality, in consideration of throughput, etc., the conveying amount, $(N-2q(k-1))\cdot p$ for transiting to the next unit area preferably satisfies a relationship of being greater than the conveying amount $q\cdot p$ between the plurality of scans.

However, a q that satisfies $q\cdot p=(N-2q(k-1))\cdot p$ does exist and such a configuration is also included in the present invention. If in this case, q also satisfies a condition of q=N/k, which is a condition of normal multi-scan, this corresponds to q=N and thus to a case of printing of one pass and thus does not satisfy the condition of multi-scan printing. Thus when in a case of multi-scan printing (of no less than two passes), the conveying amount for transiting to an adjacent unit area is defined as $(N-2q(k-1))$, these conditions do not cover normal multi-scan.

The process of masking the printing data corresponding to an unused nozzle does not necessarily have to be executed in applying the present invention. Printing data may be generated from the beginning in units of the used nozzles, set by eliminating the unused nozzles, and these data may be made to correspond to the used nozzles in each scan of the plurality of scans. For example, with the example shown in FIG. 12, printing data are generated in units of 15 nozzle blocks, which is one block less than that of the nozzle column corresponding to the length of each unit area. Then in the first scan, the data are associated with the nozzles of the second nozzle block from the upper end to those of the nozzle block at the lowermost end, and in the second scan, the data are associated with the nozzles of the nozzle block at the uppermost end to those of the second nozzle block from the lower end.

Figure 18:
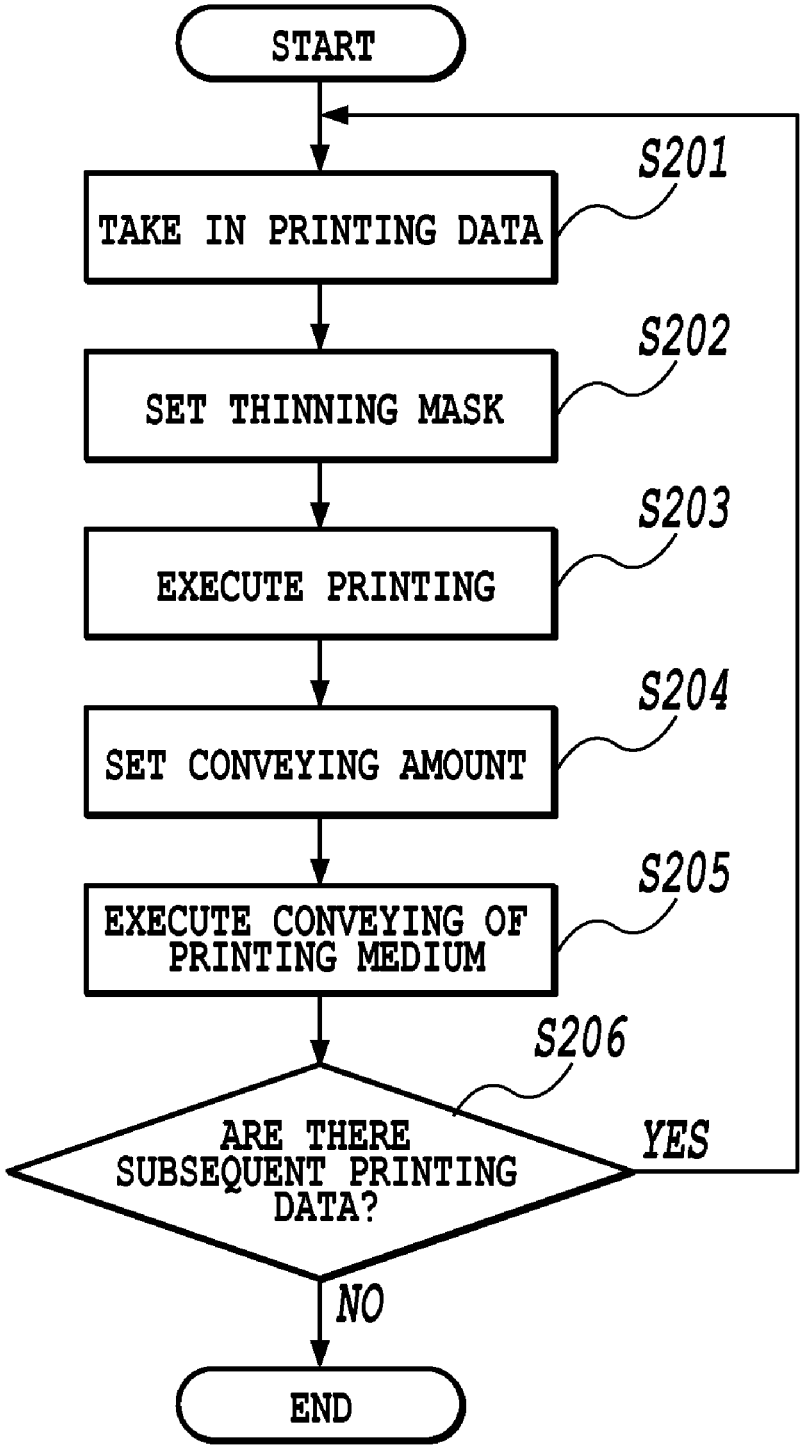
FIG. 18 is a flowchart of a printing process of a normal multi-scan printing method.

The normal multi-scan printing method of step S5, shown in FIG. 15, shall now be described. FIG. 18 is a flowchart of the printing process by this method. First, in step S201, printing data are taken in. Here, as was described in FIG. 15, the number of passes is already determined. Then in step S202, a thinning mask is set in accordance with the determined number of passes to perform the mask process, and based on the printing data generated thereby, printing is executed in step S205. Then in accordance with the conveying amount set in step S204, conveying of the printing medium is executed in step S205. Then, in step S205, it is judged whether there are subsequent printing data. If, in step S205, it is judged that there are subsequent printing data, step S201 is entered to take in image data again and the present sequence is repeated. If, in step S205, it is judged that there are no subsequent printing data, the present process is ended.

In the case of the normal multi-scan printing method, if the number of passes has been determined, printing can be performed by setting the thinning mask and the conveying amount. On the other hand, the multi-scan printing method with control of printing time interval difference differs from the normal multi-scan method in that the unused nozzles are set and the conveying amount is determined in relation to the number of the unused nozzles.

As described above, with the embodiment according to the present invention, the multi-scan printing method with control of printing time interval difference and the normal multi-scan method are switched and used according to the number of passes by which printing by the multi-scan method is completed. The between-band unevenness between unit areas can thereby be reduced. In the following, an embodiment, which lessens density variations due to printing time interval differences according to position in the scan direction in a unit area, shall be described as a second embodiment of the present invention.

Second Embodiment

According to a second embodiment of the present invention, a process of suppressing density variations due to printing time interval differences according to position in a scan direction, in both the multi-scan printing method with control of printing time interval difference, described in FIG. 15, and the normal multi-scan printing method is performed in accordance with the switching between the above two methods. Specifically, an ink applying amount that is indicated by printing data is varied in accordance with predicted density variation.

Figure 19:
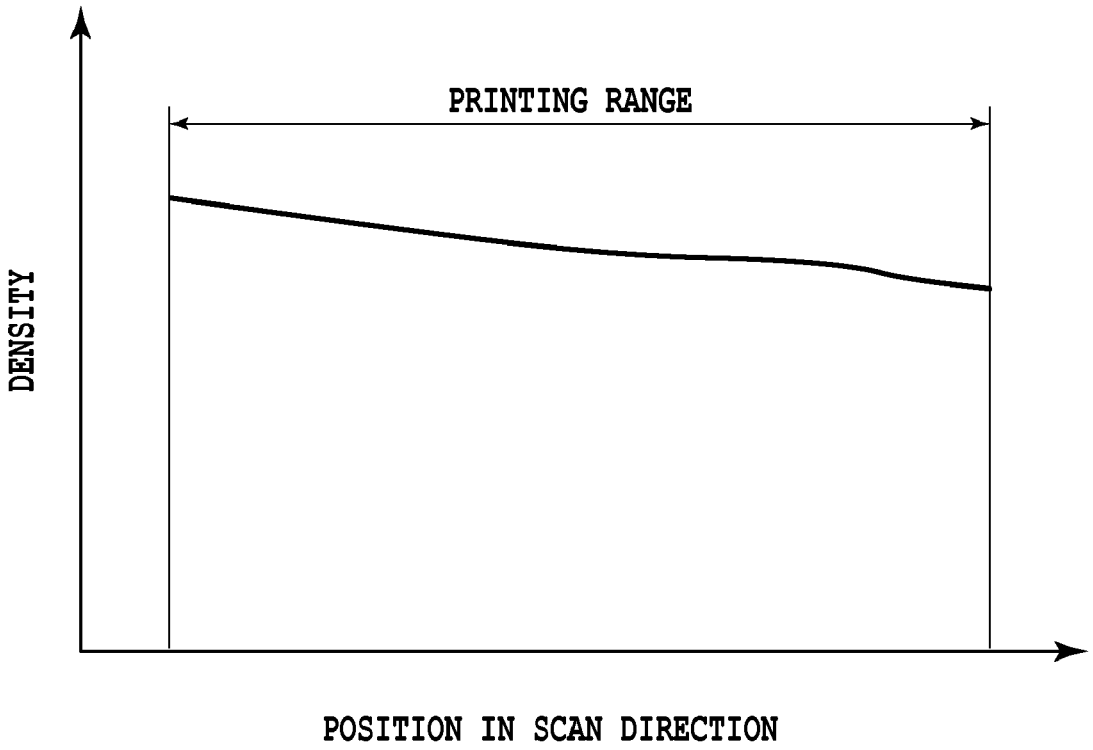
FIG. 19 is a diagram of a density variation in a scan direction in a unit area in a printing result by the multi-scan method with control of printing time interval difference shown in FIG. 12.

FIG. 19 is a diagram showing a density variation along the scan direction in a unit area of a printing result by the multi-scan printing method with control of printing time interval difference shown in FIG. 12.

Figures 6A, 6B:
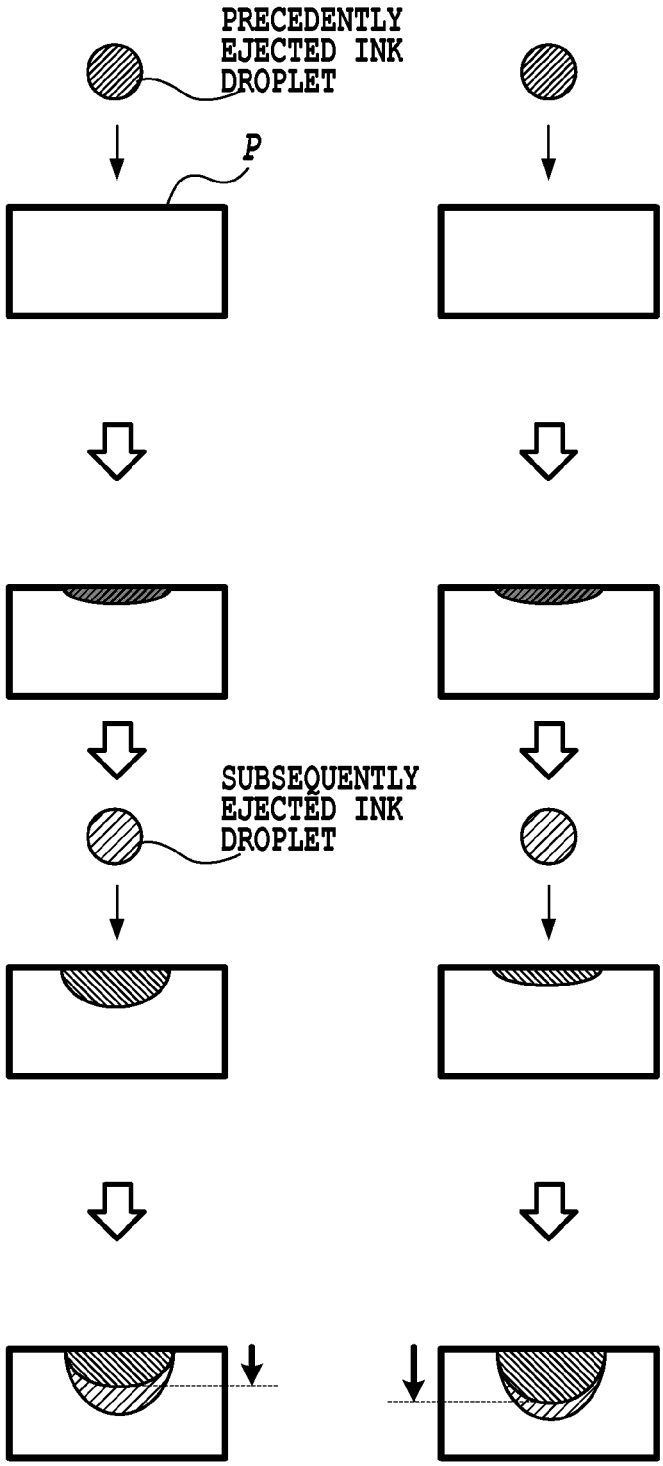
FIGS. 6A and 6B are diagrams showing manners of fixing of two ink droplets that are ejected in succession.

In FIG. 19, an abscissa denotes the position in the scan direction and an ordinate denotes the density. Here, the density is an optical reflection density of an image printed on a printing medium and is a result of measuring the density of an image, with which an area factor is maximized, that is, a single pixel is filled with ink completely and without spaces. As shown in FIG. 19, within the printed range, the density decreases from the left to the right. This is because in a region in which printing in a second scan is performed immediately after printing in a first scan, the density becomes low, and in a region in which printing in the second scan is performed after the elapse of a time substantially corresponding to two scans after the printing in the first scan, the image density becomes high. As a cause, the image density differs due to the depth of permeation of ink components varying according to a plurality of inks as shown in FIG. 6, that is, in accordance with the time interval of printing. With the above-described reasons, in the example shown in FIG. 19, within the printing range, the density decreases from the left side at which printing is performed with a long time interval between the two scans, toward the right side at which printing is performed with a short time interval.

Figure 1C:
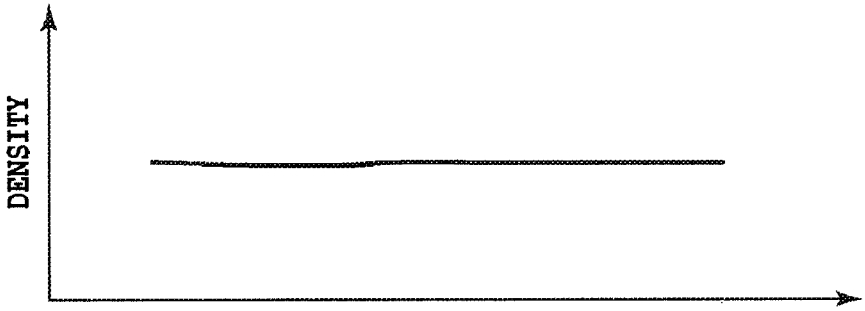
FIGS. 1A, 1B, and 1C are diagrams of an example of an ideal printing state in an inkjet printing apparatus.
Figure 1B:
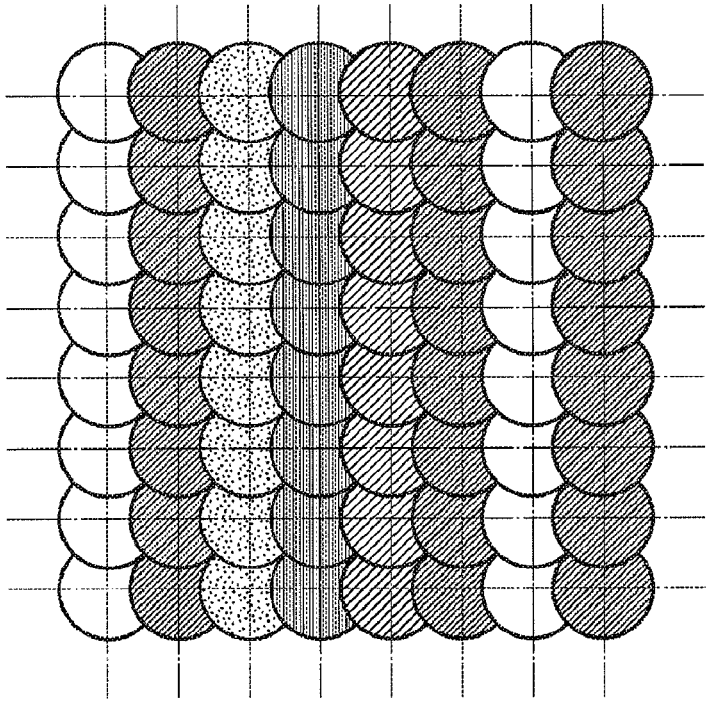
Figure 1A:
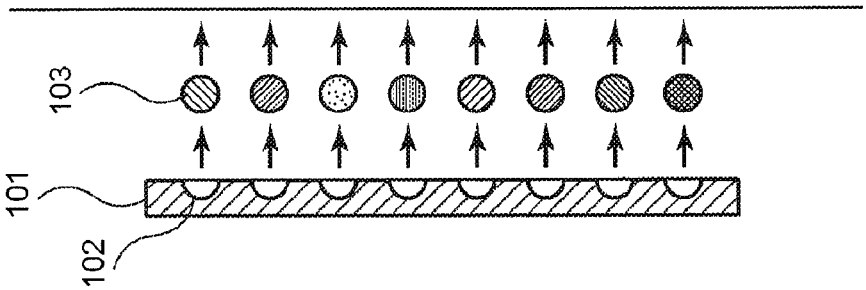
Figure 2C:
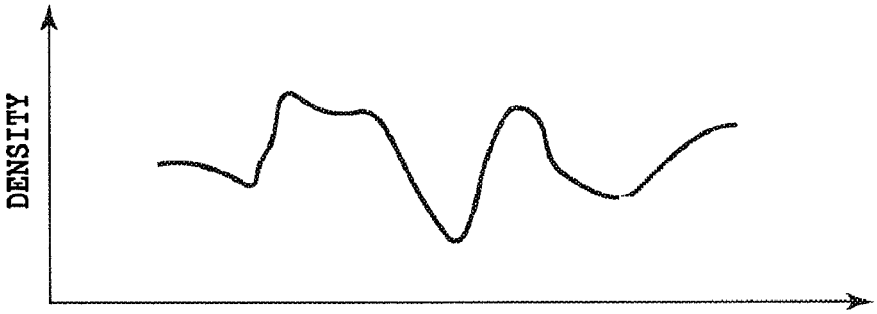
FIGS. 2A, 2B, and 2C are diagrams of an example of a printing state with density unevenness in an inkjet printing apparatus.
Figure 2B:
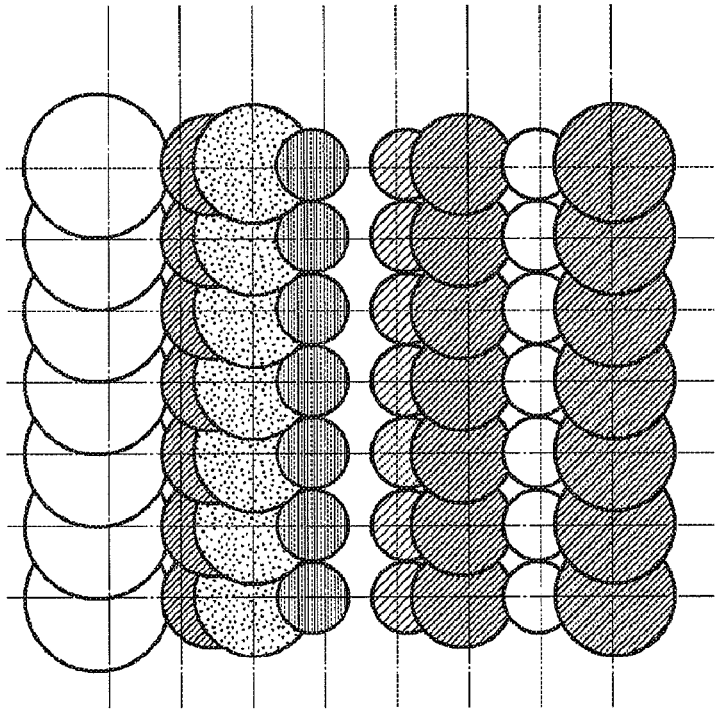
Figure 2A:
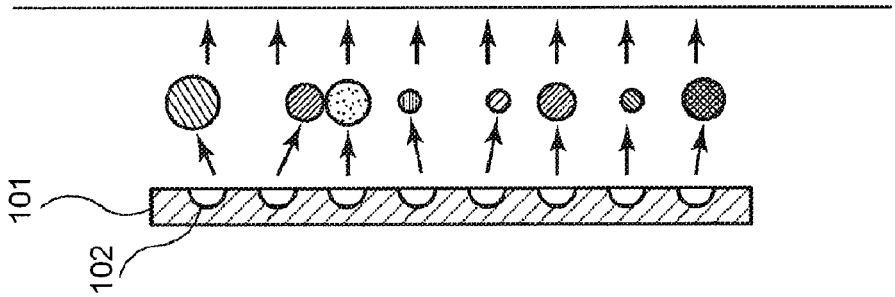
Figures 3A, 3B, 3C:
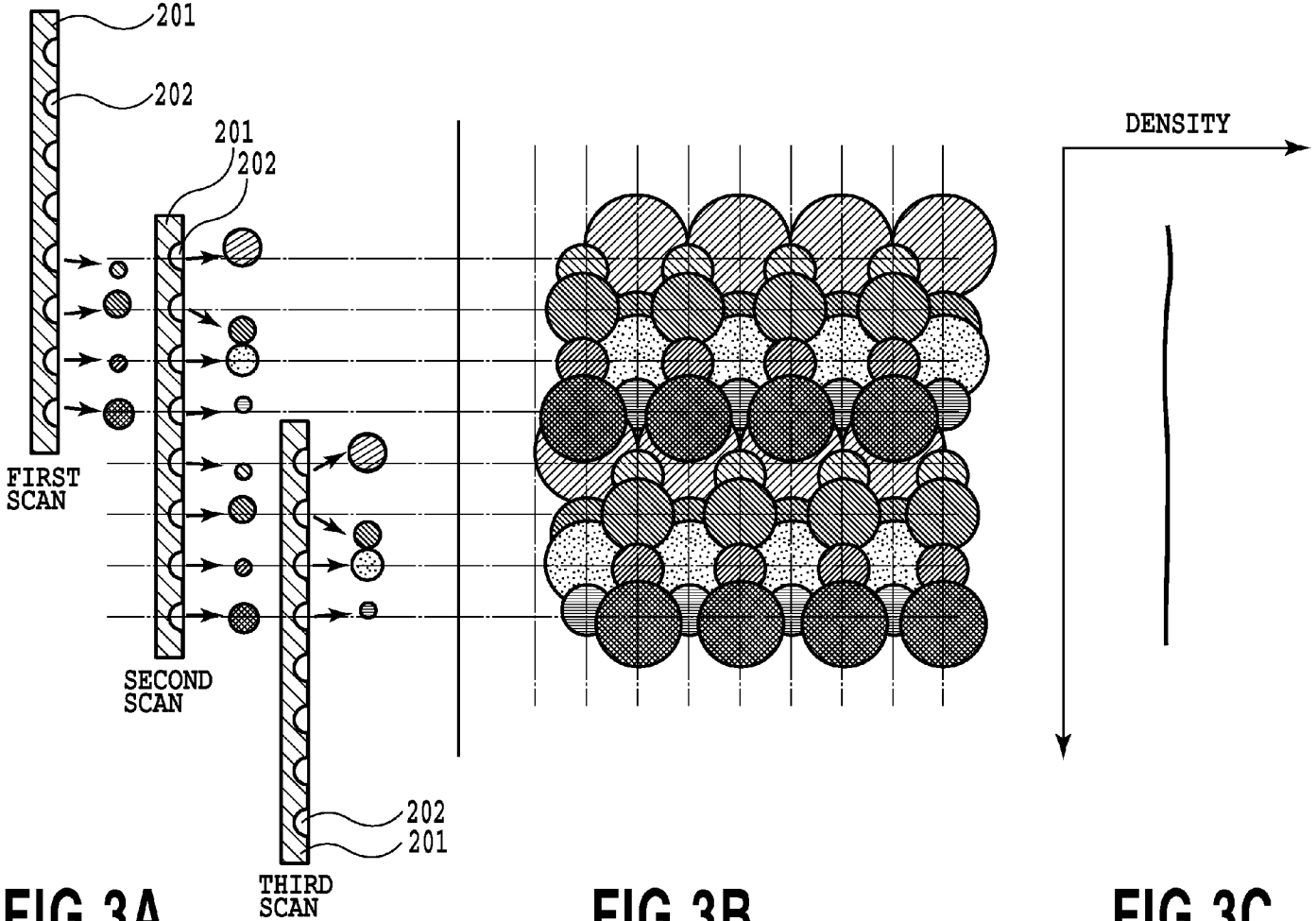
FIGS. 3A, 3B, and 3C are diagrams for describing printing where density unevenness is suppressed by a conventional example of a multi-scan method in an inkjet printing apparatus.
Figure 4A:
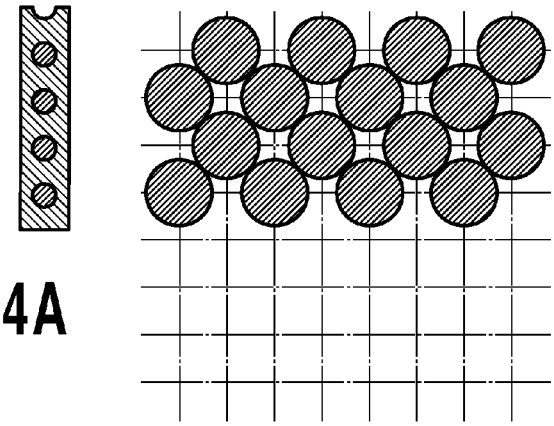
FIGS. 4A, 4B, and 4C are diagrams for describing printing according to scan in the multi-scan method.
Figure 4B:
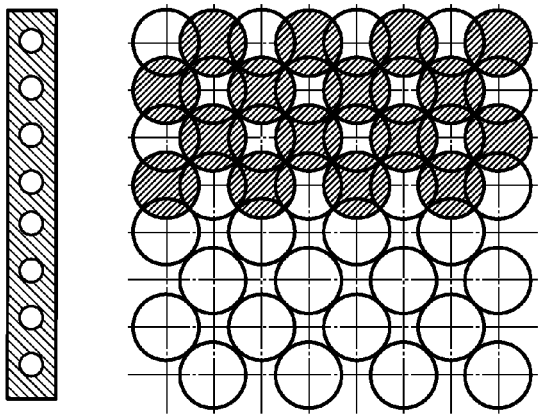
Figure 4C:
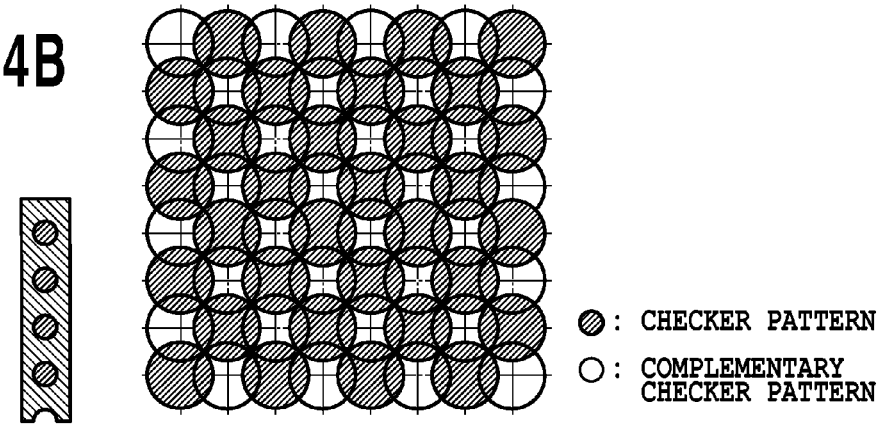
Figure 5:
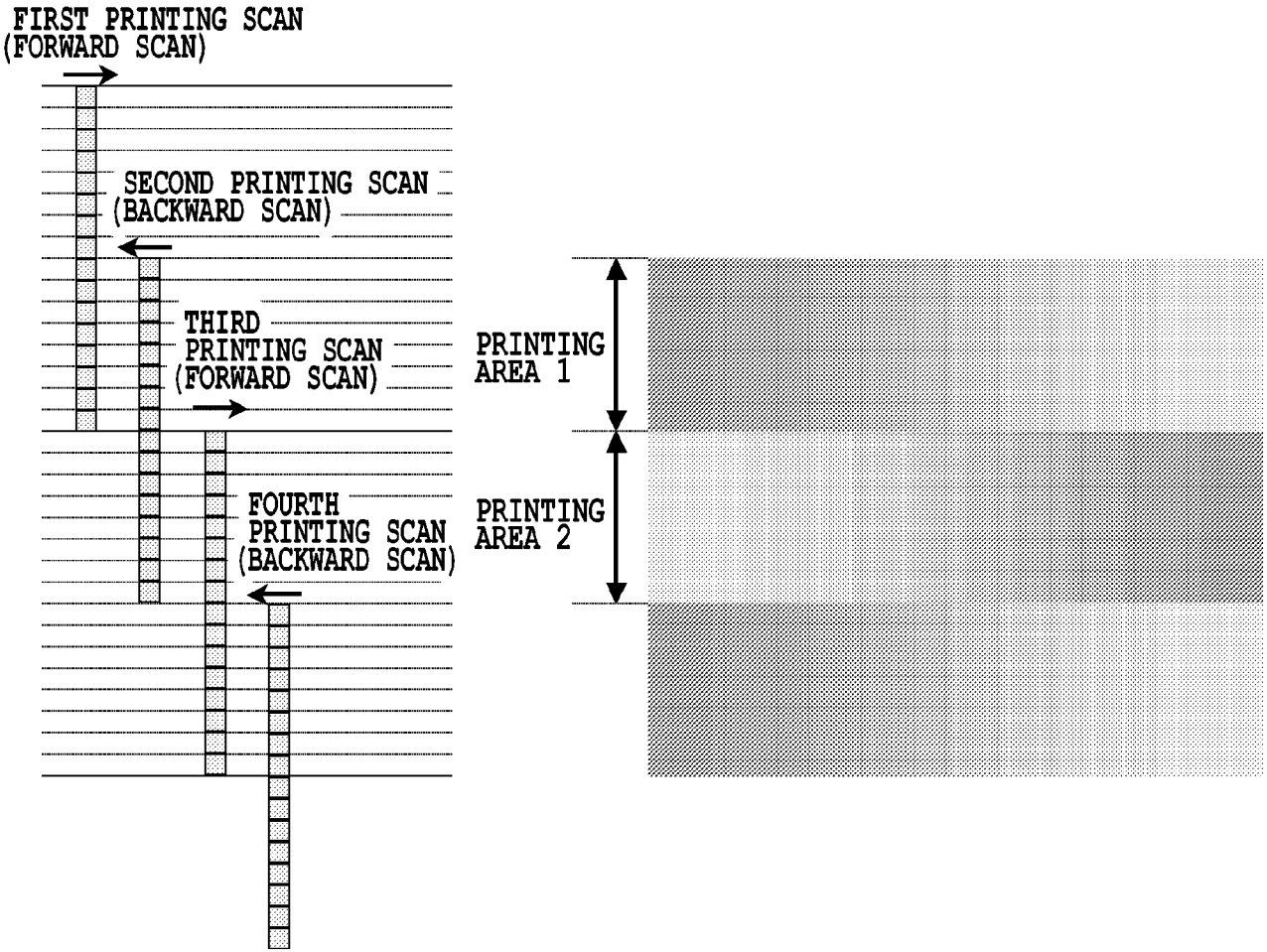
FIG. 5 is a diagram for describing density unevenness resulting from time interval differences in a conventional example of the multi-scan method.

Obviously, such a density variation occurs in a likewise manner with the normal multi-scan method as well. However, as shown in FIG. 5, in regard to the direction of density variation, there are two types of density variation, that is, the density variation shown in the "printed region 1" of the figure (left side: high→right side: low) and the density variation shown in the "printed region 2" of the figure (left side: low→right side: high). The applying amount control described below is performed in two directions when the control is applied to the normal multi-scan.

For the density variation described above, the present embodiment sets a maximum value of the ink applying amount in accordance with a position in the scan direction.

Figure 20:
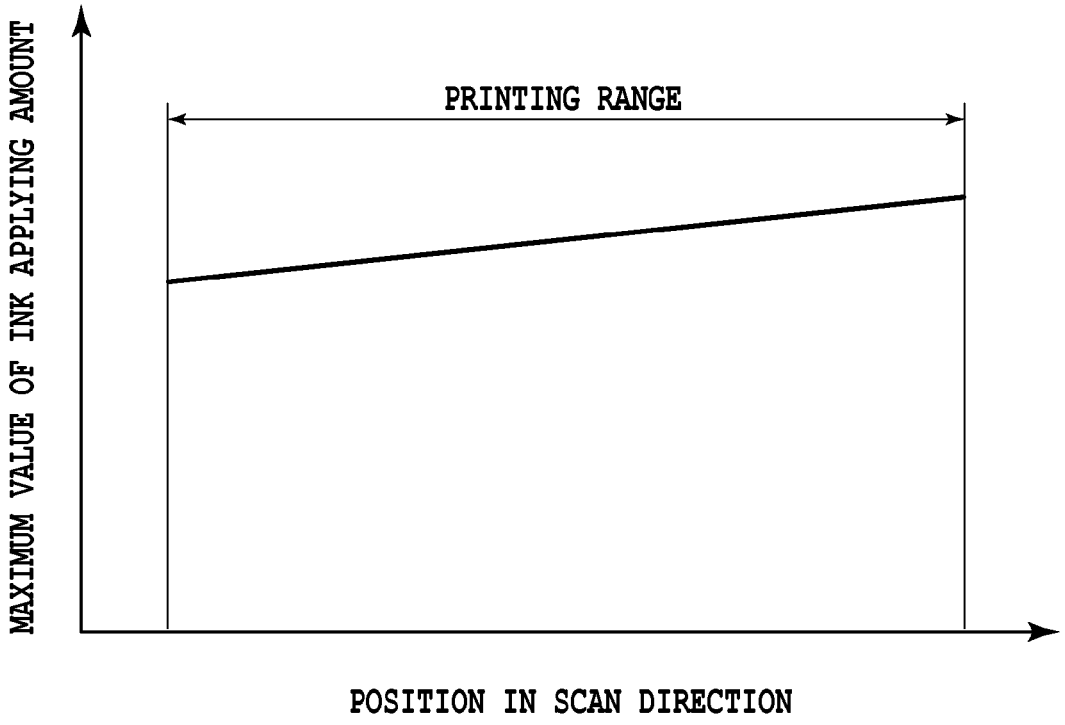
FIG. 20 is a diagram for describing a maximum value of ink applying amount that varies according to position in a scan direction and is set in accordance with the density variation shown in FIG. 19.

FIG. 20 is a diagram for describing the maximum value of ink applying amount that varies according to the position in the scan direction and is set in accordance with the density variation shown in FIG. 19. As shown in FIG. 20, within the printing range, the ink applying amount is increased from the left toward the right. This is a trend opposite that of the density variation shown in FIG. 19. That is, by performing correction of the ink applying amount according to a variation characteristic opposite that of the density variation shown in FIG. 19, the density is made uniform.

Figure 21:
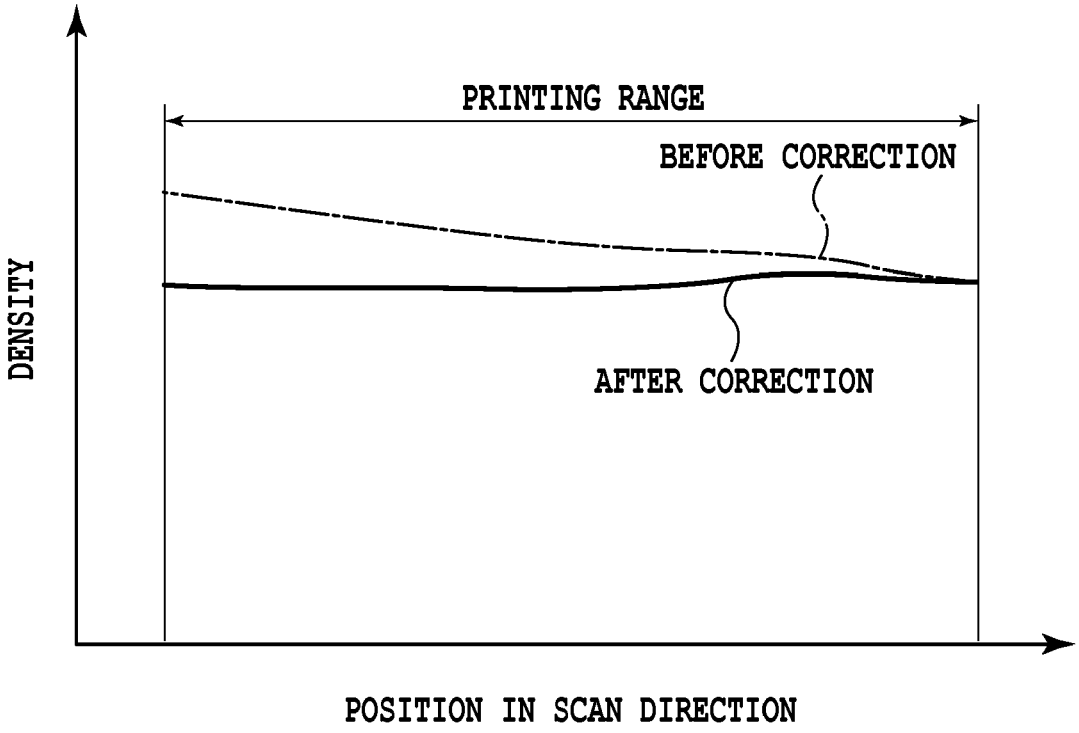
FIG. 21 is a diagram of an example of a result of performing density correction by means of the ink applying amount.

FIG. 21 is a diagram showing an example of a result of performing such a density correction. FIG. 21 shows that whereas the density variation before correction has the characteristic of decreasing from left to right, the density variation after correction has a substantially flat density characteristic regardless of the position in the scan direction. The density difference within a unit area due to the time interval difference of printing scans is thus reduced by controlling the maximum value of the ink applying amount.

Specifically, a unit area is divided into a plurality of partial areas and a maximum applying amount is set for each divided area.

FIG. 22 is a diagram showing an example of a table for setting the maximum value of the ink applying amount and the table is in accordance with the applying amount characteristic shown in FIG. 20. As shown in FIG. 22, the unit area is divided into eight areas in the scan direction, and the maximum value of the ink applying amount is set for each divided area. A largest value is set in a divided area 8 and smaller values are set in the direction toward a divided area 1. That is, in a case of a density variation such as shown in FIG. 19, because the density decreases from the left to the right within the printing range, the ink applying amount is increased from the left to the right. Thus by using a setting table for the maximum value of the ink applying amount, such as shown in FIG. 22, the amount of ink applied onto the printing medium in a final stage can be made to have a trend such as shown in FIG. 20 for the entire unit area that combines the eight divided areas. Consequently, a density correction such as shown in FIG. 21 can be performed.

Here, the setting (correction) of the ink applying amount is performed with respect to printing data before quantization. Specifically, image data, with which a single pixel is expressed in 8 bits, that is, in gray scale values of 0 to 255, are arranged as printing data according to unit area. The printing data according to unit area are then divided into eight sets of divided printing data corresponding to the eight divided areas. Furthermore, for each set of divided printing data, the table shown in FIG. 22 is referenced and the maximum applying amount value of the corresponding divided area is acquired. A process of changing the gray level value of a pixel having a gray level value that exceeds the maximum value to the acquired maximum value is then performed. For example, when a certain pixel in the "divided area 1" has a gray level value exceeding 255×93%, a process of changing the gray level value to 255×93% is performed.

In place of the above-described setting of the upper limit value of the applying amount, a table used for gamma correction may be changed. For example, eight gamma correction tables, with which maximum output values correspond to the respective maximum applying amount values shown in FIG. 22, are prepared. FIG. 23 is a diagram of a table for selecting a gamma correction table according to each divided area.

By thus using the gamma correction tables, density correction can be performed not only in portions in the printed image where the ink applying amount is high but also in portions of intermediate gray level, etc.

As described above, by setting the maximum value of the ink applying amount depending on divided areas in the scan direction, density variations due to printing time interval differences in the scan direction in each unit area can be reduced.

As mentioned above, this control of applying amount is applied to both multi-scan with control of printing time interval difference and normal multi-scan. Thus in multi-scan printing with control of printing time interval difference, the between-band unevenness can be reduced significantly and density variations in the scan direction in each unit area can also be reduced. In normal multi-scan printing, density variations in the scan direction in each unit area can be reduced, and consequently, density differences at the same position in the scan direction between adjacent unit areas (bands) can also be reduced.

(Modification of the Second Embodiment)

Regarding density differences due to ink ejection time interval differences, the influence of the time interval difference on density differs depending on relative characteristics of a printing medium with respect to ink. In the present modification, the maximum value of the ink applying amount is set depending on the type of printing medium.

FIG. 24 is a diagram showing the maximum values of the ink applying amount in the scan direction according to the type of printing medium. As shown in FIG. 24, with all printing mediums, the maximum value of the ink applying amount is increased from the left to right according to the divided areas. This is done, as described y the first embodiment, to exhibit a trend opposite that of the density variation shown in FIG. 19, and the density in the scan direction can thereby be made uniform. Furthermore, a "printing medium 1" has characteristics of being comparatively insensitive to printing time interval differences and being unlikely for a density difference to occur even when there is a time interval difference. The maximum value of the ink applying amount thus does not have to be varied greatly. Meanwhile, a "printing medium 3" has characteristics of being comparatively sensitive to time interval differences and being such that the printing time interval difference greatly influences the density difference. The maximum value of the ink applying amount is thus varied greatly. A "printing medium 2" has characteristics intermediate to those of the "printing medium 1" and the "printing medium 3." By thus setting the maximum value of the ink applying amount in modes that differ according to the type of printing medium, density variations in the scan direction due to time interval differences of printing scans can be reduced regardless of the type of printing medium. A density difference within a printing area due to a time interval difference of printing scans can thus be suppressed by restricting the maximum value of the ink applying amount.

The characteristics according to the type of above-described printing medium are related to the phenomenon of permeation of ink into the printing medium and there are thus cases where an environmental temperature, humidity, etc., also have an influence. More preferably, by providing a setting table for correcting for the environmental temperature and humidity, the density difference within the printing area due to the time interval differences of printing scans can be suppressed with better precision.

In place of just the upper limit value of the applying amount, gamma correction tables may be set according to the divided areas in accordance with the type of printing medium in the present embodiment as well.

As described above, by setting the maximum value of the ink applying amount depending on the type of printing medium, density variations in the scan direction due to printing time interval differences in the bidirectional multi-scan method can be reduced satisfactorily even when the type of printing medium used changes.

Other Embodiments

Although with the respective embodiments described above, the applying amount expressed by printing data is changed according to the position in the scan direction, the present invention is not limited in application to such a mode. For example, an ejection amount of each nozzle in the print head may be changed instead. For example, with a head of an arrangement with which an electro-thermal converter is used to generate bubbles and eject ink, the ejection amount can be changed by changing a waveform of an electric pulse supplied to the electro-thermal converter. With an arrangement with which ink is ejected by pressure by electromechanical conversion using a piezoelectric element, the ejection amount can be changed by changing a voltage applied to the piezoelectric element. The amount of ink that is shot onto a fixed region in the final stage can thus be changed by changing the ink amount ejected from the print head in itself according to the position in the scan direction and the time interval unevenness according to position in a unit area can thereby be reduced.

Also, the respective embodiments described above are related to bidirectional multi-scan of a unit area having a length corresponding to a nozzle column, resulting from division of a nozzle array of a print head. That is, for each of a plurality of scans, the printing medium is conveyed by a predetermined amount in a relative manner with respect to the print head and printing is performed using different nozzles in association. However, the present invention is not limited in application to this mode and can obviously be applied to a mode where printing of a unit area is completed by performing reciprocal scans of the print head at the same position with respect to the unit area of the printing medium without performing conveying of the printing medium in between.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-214041, filed Aug. 20, 2007 and 2007-214057, filed Aug. 20, 2007, which are hereby incorporated by reference herein in their entirety.

What is claimed is:

1. An ink jet printing apparatus capable of performing bidirectional printing in which scans of a print head, on which a plurality of ejection ports for ejecting ink are arranged, are performed in forward and backward directions, and ink is ejected from the print head during the scans in the forward and backward directions so as to print an image on a printing medium, said apparatus comprising:

a controller for executing the bidirectional printing by performing a plurality of scans of the print head, between which conveying of the printing medium is performed by a predetermined amount that is smaller than an arrayed range of the plurality of ejection ports, for each of unit areas adjacent to each other in a conveying direction of the printing medium, wherein said controller performs the conveying of the printing medium by an amount of $(N-2q(k-1))\cdot p$;

wherein N is a number of the plurality of ejection ports, q is the predetermined amount, k is a number of the plurality of scans, and p is an array pitch of the plurality of ejection ports; and wherein a length of the unit area along the conveying direction is a length of $(N-q(k-1))\cdot p$ that corresponds to a number of ejection ports that overlap among the plurality of scans for printing the unit area.

2. The ink jet printing apparatus as claimed in claim 1, further comprising a unit for differentiating a maximum ink applying amount depending on positions in a scan direction in the unit area.

3. An ink jet printing method of performing bidirectional printing in which scans of a print head, on which a plurality of ejection ports for ejecting ink are arranged, are performed in forward and backward directions, and ink is ejected from the print head during the scans in the forward and backward directions so as to print an image on a printing medium, said method comprising:

a printing step of executing the bidirectional printing by performing a plurality of scans of the print head, between which conveying of the printing medium is performed by a predetermined amount that is smaller than an arrayed range of the plurality of ejection ports, for each of unit areas adjacent to each other in a conveying direction of the printing medium, wherein in said printing step, the conveying of the printing medium by an amount of $(N-2q(k-1))\cdot p$;

wherein N is a number of the plurality of ejection ports, q is the predetermined amount, k is a number of the plurality of scans, and p is an array pitch of the plurality of ejection ports, is performed; and wherein a length of the unit area along the conveying direction is a length of $(N-q(k-1))\cdot p$ that corresponds to a number of ejection ports that overlap among the plurality of scans for printing the unit area.

* * * * *